US006210351B1

(12) United States Patent
Korenaga

(10) Patent No.: US 6,210,351 B1
(45) **Date of Patent: *Apr. 3, 2001**

(54) MASSAGING WATER BED

(76) Inventor: Tetsuya Korenaga, c/o Celcom, Inc., 2-13, Tokojimachi 2-chome, Hakata-ku, Fukuoka-shi, Kukuoka 816-0096 (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/077,947

(22) PCT Filed: Feb. 13, 1997

(86) PCT No.: PCT/JP97/00402

§ 371 Date: Jun. 5, 1998

§ 102(e) Date: Jun. 5, 1998

(87) PCT Pub. No.: WO97/29728

PCT Pub. Date: Aug. 21, 1997

(30) Foreign Application Priority Data

Feb. 14, 1996 (JP) ..... 8-027011

(51) Int. Cl.[7] ..... A61H 7/00
(52) U.S. Cl. ..... 601/148; 601/149; 5/670
(58) Field of Search ..... 601/148, 149, 601/150, 154, 155, 156, 157, 158, 159; 5/670

(56) References Cited

U.S. PATENT DOCUMENTS

| | | | | |
|---|---|---|---|---|
| 4,607,405 | * | 8/1986 | Ellis et al. | 5/670 |
| 4,635,620 | * | 1/1987 | Ricchio | 601/148 |
| 4,757,808 | * | 7/1988 | Effler, Jr. | 601/148 |
| 4,908,016 | * | 3/1990 | Thomsen | 601/156 |
| 4,976,256 | * | 12/1990 | Marlin et al. | 601/55 |
| 5,540,651 | * | 7/1996 | Risch et al. | 601/148 |
| 5,713,834 | * | 2/1998 | Palmer | 601/149 |

* cited by examiner

*Primary Examiner*—Michael A. Brown
*Assistant Examiner*—Benjamin K. Koo
(74) *Attorney, Agent, or Firm*—Jordan and Hamburg LLP

(57) ABSTRACT

A water bed type massaging machine which can stimulate a person being massaged in different positions, which are symmetrical in a breadthwise direction of the person's shoulders with respect to the person's backbone, at a suitable temperature. Water or hot water is filled into a box-shaped water container having an opening at its top, and a flexible sheet is provided over the opening in a watertight manner to constitute a water bed enabling a person being massaged to lie on the top surface of the flexible sheet. Right and left nozzles capable of jetting water or hot water against the back surface of the flexible sheet are provided in the water container so that they can be moved in a heightwise direction of the person being massaged and in the breadthwise direction of the person's shoulders. The nozzles can be transferred, including rotated.

4 Claims, 27 Drawing Sheets

MASSAGING WATER BED

TECHNICAL BACKGROUND

The present invention relates to a water bed type massaging machine so adapted as to massage the body of a person. More particularly, the present invention relates to a water bed type massaging machine with a water bed filled with water or hot water, so designed as to enable massaging the entire body of a person lying on the water bed.

BACKGROUND TECHNOLOGY

Hitherto, International Application No. PCT/US90/03505 (International Publication No. WO90/15585) discloses a massaging machine of a bed type which can massage the entire body of a person.

This massaging machine includes a housing constituting a massaging chamber within the interior thereof with its top side open, a flexible sheet disposed on the open top side of the housing for supporting a person lying thereon, a fluid jet apparatus disposed in the massaging chamber for blowing jet streams towards the flexible sheet, and a pressurized fluid supply unit for supplying pressurized fluid to the fluid jet apparatus.

The fluid jet apparatus is constructed in such a manner that it can slide in a lengthwise direction through the inside of the massaging chamber and that it can massage the entire body of the person lying on the flexible sheet by allowing the jet streams to come into touch with the body of the person from the back side of the flexible sheet while sliding the fluid jet apparatus.

The conventional massaging machine as disclosed in the above-mentioned International Application No. PCT/US90/03505 (International Publication No. WO90/15585), however, allows the fluid jet apparatus to move only in the lengthwise direction within the massaging chamber.

Generally, when massaging the body of a person, higher massaging effects can be achieved by stimulating the areas of the body of the person being massaged, which are symmetrical on the left- and right-hand sides in a breadthwise direction of the person's shoulders with respect to the person's backbone by an appropriate magnitude of temperature. Accordingly, where the fluid jet apparatus can be moved only in the lengthwise direction within the massaging chamber, the such massaging machine cannot be said that it can provide sufficient massaging effects.

The such conventional massaging machine suffers from the disadvantages that the fluid supply apparatus and a device such as a pipe or the like for supplying pressurized fluid to the fluid supply apparatus are forced to become larger in size because it is so constructed as to support the person being massaged with the flexible sheet alone, so that the flexible sheet has to be sufficiently thick enough from the point of view of strength to support the body of the person being massaged yet it has to be sufficiently thin enough to allow the blowing pressure to be transmitted to the body of the person being massaged through the thickness of the flexible sheet.

Further, the flexible sheet having such a somewhat thick dimension may have the problems that it provides a poor feeling of resting on the flexible sheet and it cannot be fitted comfortably to the shape of the body of the person being massaged.

Although it is generally known that a higher massaging effect can be gained by carrying out the massaging while warming the body of the person being massaged, the thick flexible sheet is unlikely to be warmed readily by heating the fluid so that such a cold flexible sheet may reduce the massaging effects to a great extent.

Moreover, as the conventional massaging machine is equipped with no device for forcibly cooling down the temperature of warm water or the like filled in a water container, it may present the defect that the massaging cannot be carried out at an optimal temperature for a long period of time because the temperature of hot water or the like in the water container is caused to arise due to friction of the water filled therein when the massaging machine is operate d continually for a long time.

DISCLOSURE OF THE INVENTION

Therefore, the present invention provides a water bed type massaging machine, having a water bed formed in a box-shaped water container with an opening portion formed oh top thereof in which water or warm water is filled, and a flexible sheet disposed extending over the opening portion thereof in a water-tightly closed manner so as to allow a person to lie on the upper side of the flexible sheet, in which left and right nozzles are disposed in the interior of the water container to sprinkle water or warm water onto the bottom side of the flexible sheet and the left and right nozzles are disposed so as each to move, including rotate, in the heightwise direction of the height of a person being massaged while lying on the flexible sheet and in the breadthwise direction of the shoulder of the person being massaged.

In a preferred embodiment of the present invention, there is provided a water bed type massaging machine having a water bed formed in a box-shaped water container with an opening portion formed on top thereof in which water or warm water is filled, and a flexible sheet disposed extending over the opening portion thereof in a water-tightly closed manner so as to allow a person to lie on the upper side of the flexible sheet, in which a pair of left and right nozzles are disposed in the interior of the water container to sprinkle water or warm water onto the bottom side of the flexible sheet and the left and right nozzles are disposed in a relationship spaced apart along the breadthwise direction of the shoulders of the person being massaged while lying on the flexible sheet so as to be movable in the heightwise direction of the height of the person being massaged and further in which the pair of the left and right nozzles are disposed so as to be movable, including movable rotatably, which are symmetrically transversely on the left and right sides in the breadthwise direction of the shoulders of the person being massaged.

In another preferred embodiment, the present invention provides a water bed type massaging machine having the pair of the nozzles disposed so as to move, including rotate, in such a manner that the carrier is disposed in the water container so as to be movable in the heightwise direction of the person being i massaged, a pair of gears for moving the nozzles are supported axially in an engaging state on the upper side of the carrier so as to be rotatable, and the pair of the nozzles are disposed on the pair of the gears.

The water bed type massaging machine is further provided with a temperature adjustment means for adjusting the temperature of water or warm water filled in the water container.

BEST MODE FOR CARRYING OUT THE INVENTION

The present invention will be described in more detail with reference to the accompanying drawings.

Figure 1:
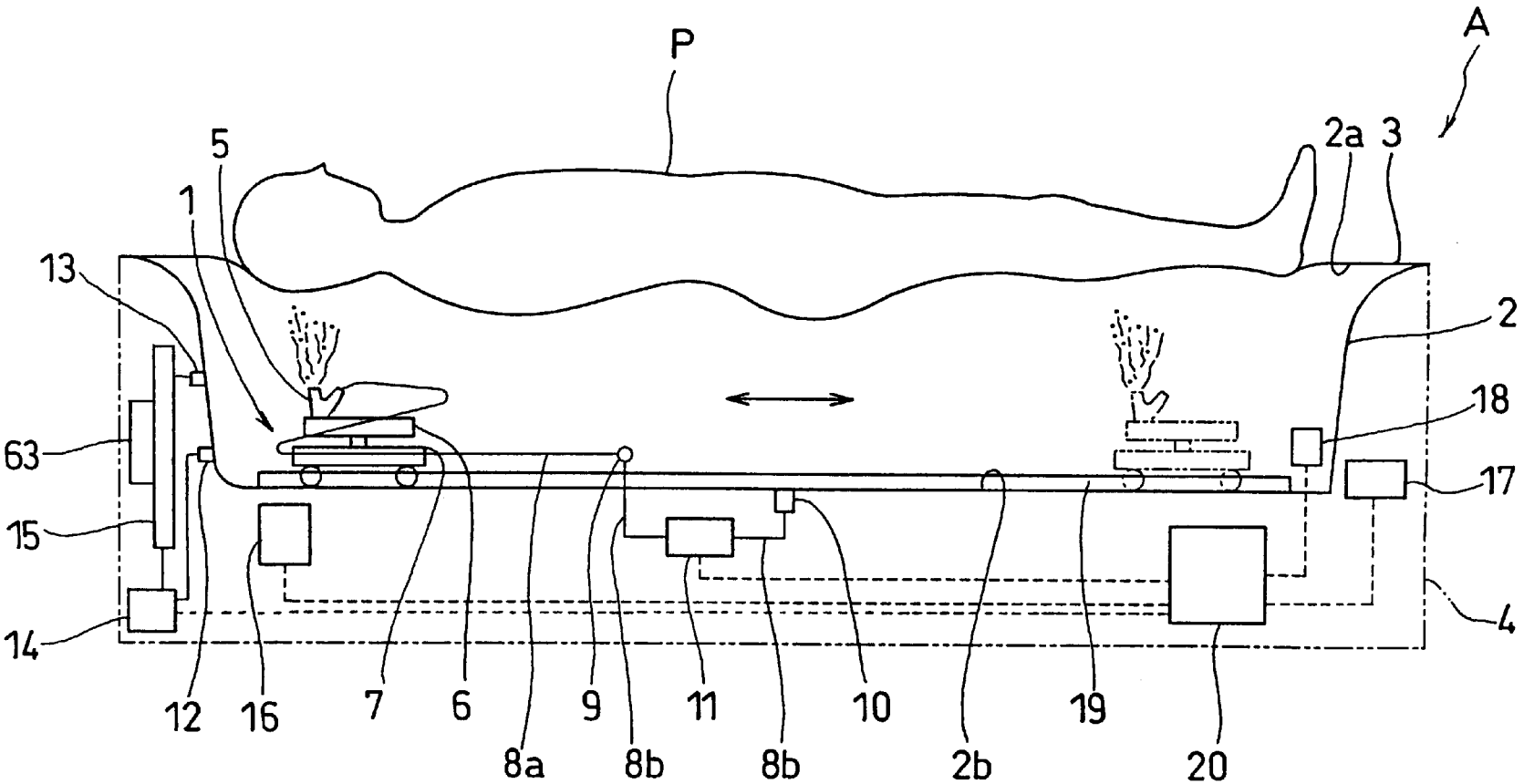
FIG. 1 is a side view showing a water bed type massaging machine according to an embodiment of the present invention.
Figure 2:
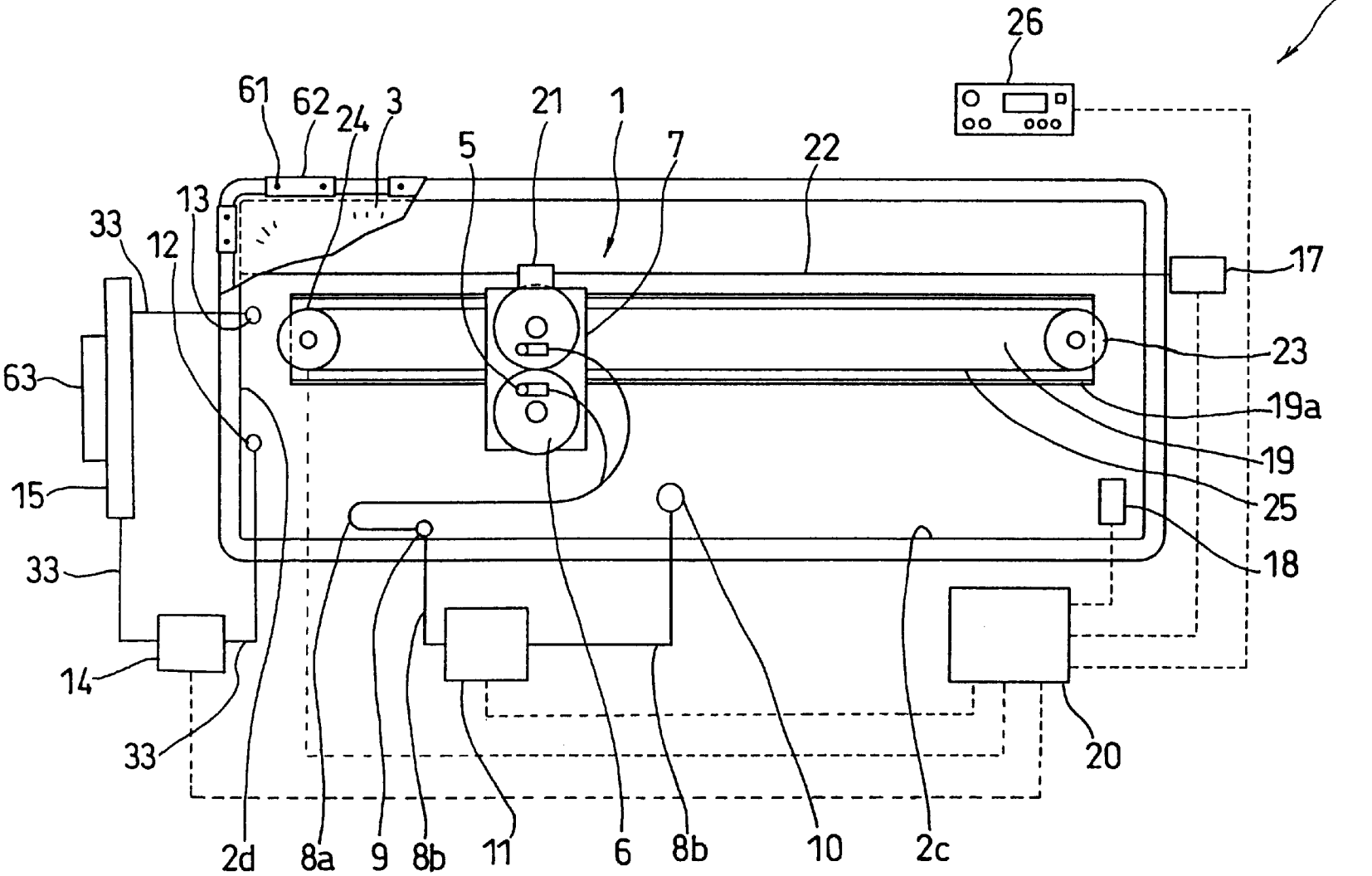
FIG. 2 is a plan view for describing the water bed type massaging machine according to the embodiment thereof said jet

FIGS. 1 and 2 are schematic views illustrating a usage status of the water bed type massaging machine according to an embodiment of the present invention. A water bed type massaging machine A according to the embodiment of the present invention is constructed with a water bed having a rectangular box-shaped water container 2 with an opening portion 2*a* on top thereof in which water or warm water is filled, and a flexible sheet 3 mounted extending over the opening portion 2*a* in a water-tight manner. On the bottom surface 2*b* of the water container 2 is mounted a jet device 1 so as to be movable in a reciprocal way toward the heightwise direction and the breadthwise direction of the shoulders of a person P being massaged while lying on the flexible sheet 3.

A detailed description will now be made of the construction of each portion of the water bed type massaging machine A.

As shown in FIGS. 1 and 2, the water container 2 is formed with a water inlet 10 in the bottom surface 2*b* thereof and a water outlet 9 in a side wall 2*c* thereof. Between the water inlet 10 and the water outlet 9 is interposed a circulating pump 11 in a relationship spaced therefrom. With the water outlet 9 are communicated nozzles 5 and 5 disposed in the jet device 1 so as to be associated therewith. In the drawings, reference symbol 8*a* stands for a flexible water discharge hose capable of following the reciprocal movement of the jet device 1 and branched off into two sections which in turn are connected to the nozzles 5 and 5 and reference symbol 8*b* stands for a connecting pipe.

Driving the circulating pump 11 allows a suction of warm water or the like in the water container 2 through the water inlet 10 and a jetting of warm water or the like from the nozzles 5 and 5.

As shown in FIG. 2, the water container 2 is also provided with a drive pulley 24 and a follower pulley 23 at the both lengthwise ends of the bottom surface 2*b* and a belt 25 for transferring the jet device is wound between the follower pulley 23 and the drive pulley 24. A rail 19 is disposed beneath and in parallel to the belt 25 for transferring the jet device and a spline shaft 22 for transferring the nozzles 5 and 5 in the breadthwise direction of the shoulders of the person on the side of and along the belt 25 for transferring the jet device.

Then, a description will be made of the construction of the jet device 1 by breaking it down into the construction for transferring the nozzles 5 and 5 in the heightwise direction of the person P being massaged and the construction for transferring them in the breadthwise direction of the shoulders of the person.

First, a description will be made of the construction of the jet device 1 for transferring the nozzles 5 and 5 in the heightwise direction of the person P being massaged.

Figure 3:
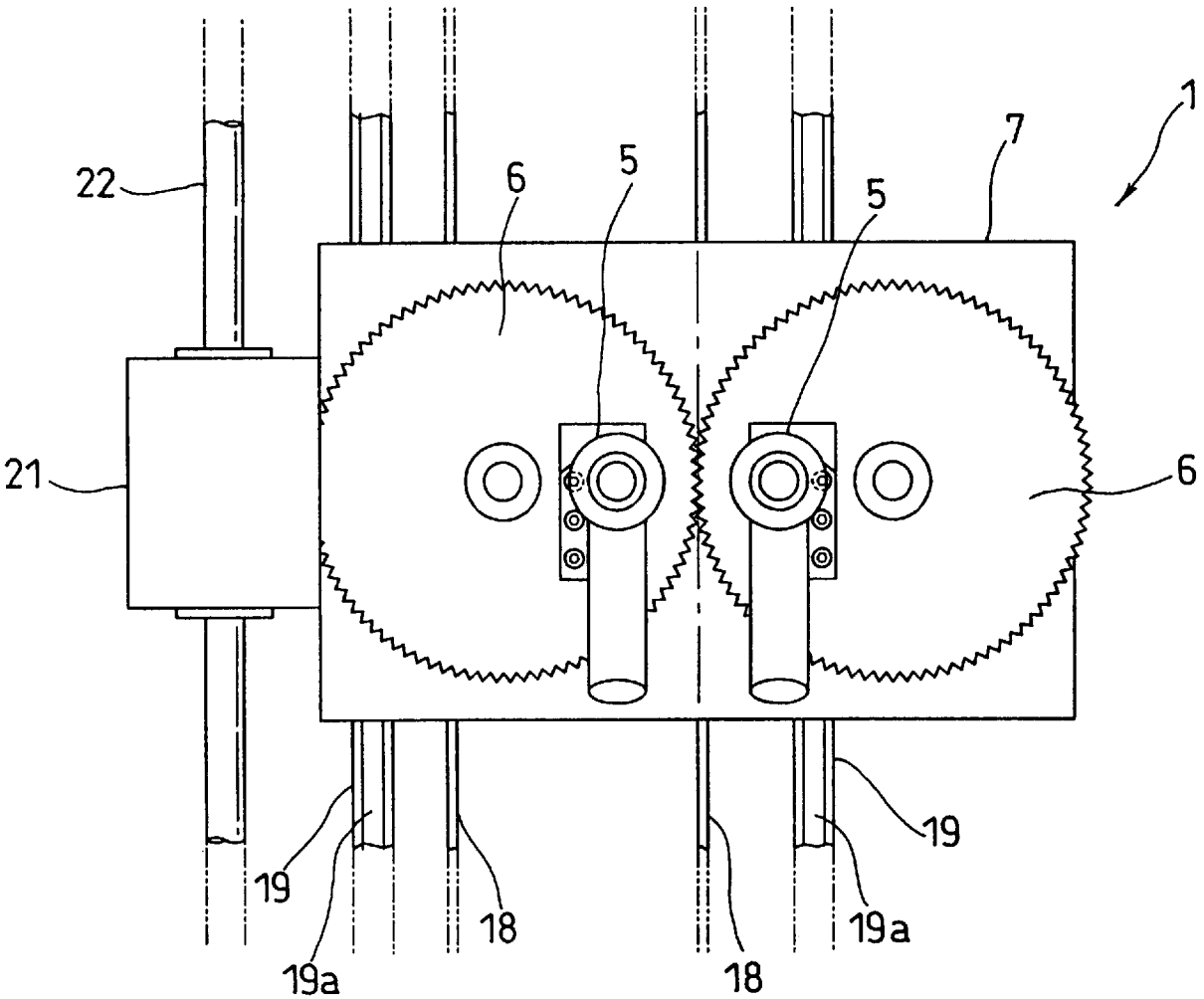
FIG. 3 is a plan view showing a jet device.
Figure 4:
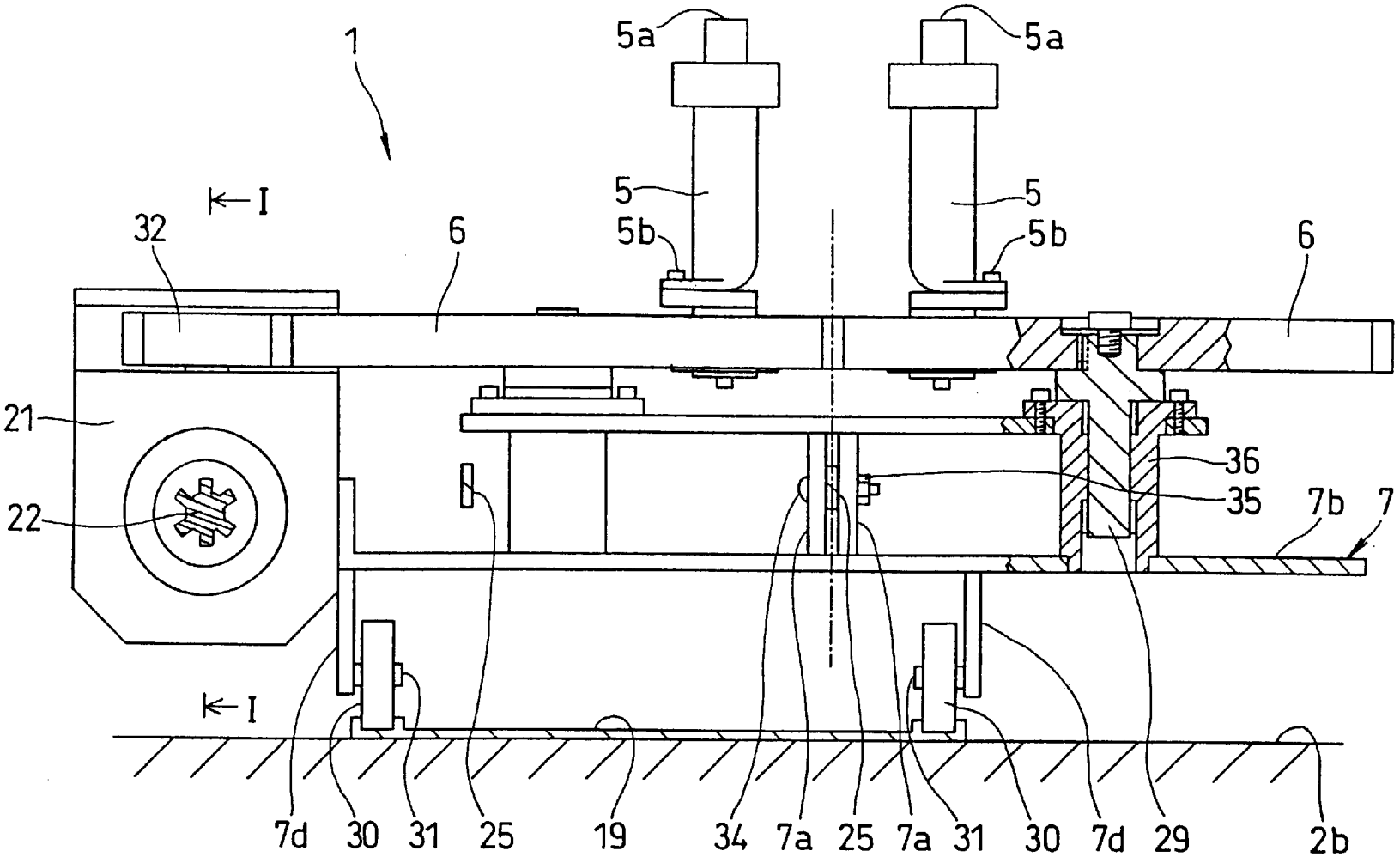
FIG. 4 is a partially cut-away plan view of the jet device.

As shown in FIGS. 3 and 4, the jet device 1 has a pair of gears 6 and 6 for transferring the nozzles disposed on an upper side of a carrier 7 and rolling wheels 30 and 30 on a bottom side of the carrier 7.

The carrier 7 has support members 7*d* and 7*d* for supporting the rolling wheels mounted suspending down from a bottom side surface of a base table 7*b* in the form of a flat plate and the rolling wheels 30 and 30 are supported axially with the support members 7*d* and 7*d* for supporting the rolling wheels. In the drawings, reference numeral 31 stands for a rotary shaft.

The carrier 7 is also provided with belt support members 7*a* and 7*a* upstanding on the upper side surface of the base table 7*b* and the belt 25 for transferring the jet device is clamped with the belt support members 7*a* and 7*a*. In the drawing, reference numerals 34 and 35 stand for a fixing bolt and a fixing nut, respectively.

Figure 5:
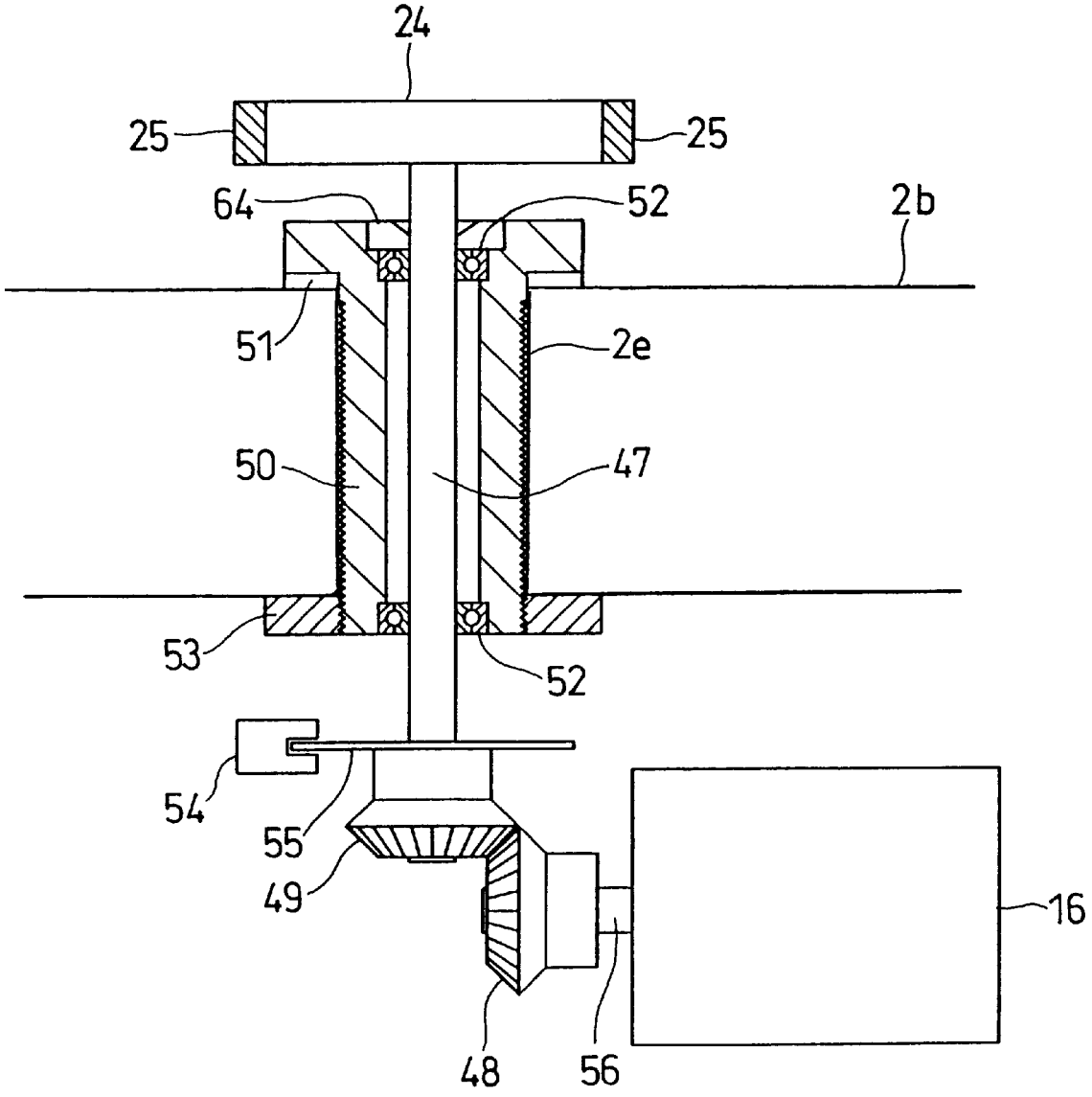
FIG. 5 is a plan view showing a mechanism for transferring the jet device.

Now, a description will be made of a mechanism for rotatably transferring the belt 25 for transferring the jet device with reference to FIG. 5. The belt 25 for transferring the jet device is associated with and connected to a motor 16 for driving the belt disposed at the bottom side of the water container 2 through the drive pulley 24. More specifically, a pulley shaft 47 is associated with and connected to the motor 16 for driving the belt and the drive pulley 24 is mounted on the top of the pulley shaft 47 with which in turn is installed the belt 25 for transferring the jet device. The pulley shaft 47 is supported with a cylinder 50 for supporting the pulley shaft mounted through a throughhole 2*e* formed in the bottom surface 2*b* of the water container 2 so as to be rotatable. In the drawing, reference numeral 48 stands for a drive bevel gear mounted on an output shaft 56 of the belt-driving motor 16, reference numeral 49 for a follower bevel gear engageable with the drive bevel gear 48, reference numeral 51 for a packing member, reference numeral 52 for a bearing, reference numeral 53 for a mounting nut, and reference numeral 64 for an oil seal.

The belt 25 for transferring the jet device is rotated by driving the belt-driving motor 16 to allow a reciprocal movement of the jet device 1 connected to the belt 25 in the lengthwise direction of the water container 2 along the rail 19, in other words, in the heightwise direction of the person P being massaged while lying on the flexible sheet 3.

At a bottom edge portion of the pulley shaft 47 is disposed a rotary encoder 54 to specify the position of the jet device 1 by measuring an amount of rotation of the pulley shaft 47. In the drawing, reference numeral 55 stands for a detecting disk mounted on the bottom edge portion of the pulley shaft 47.

Then, a description will be made of the construction of the jet device 1 for transferring the nozzles 5 and 5 in the breadthwise direction of the shoulders of the person P being massaged.

As shown in FIGS. 3 and 4, the jet device 1 is axially supported on an upper side of the carrier 7 in a state that a pair of the gears 6 and 6 for transferring the nozzles are engaged with each other. More specifically, shaft support cylinders 36 and 36 are disposed upstanding on the upper surface of the base table 7*b* of the carrier 7 and rotating shafts 29 and 29 of the respective gears 6 and 6 for transferring the nozzles are inserted into hollow portions of the shaft support cylinders 36 and 36. On the upper surface of the gears 6 and 6 for transferring the nozzles are mounted the nozzles 5 and 5 so as to be rotatable axially about the rotary shaft 5*b*. In the drawing, reference symbol 5*a* stands for a blow-off outlet of the nozzle 5.

A description will now be made of a mechanism for rotating the gears 6 and 6 for transferring the nozzles with reference to FIGS. 4 and 6. The gears 6 and 6 for transferring the nozzles are associated with and connected to the spline shaft 22 which in turn is spline-engaged with a driving bevel gear 40 to allow an association with and a connection to the gears 6 and 6 for transferring the nozzles. The driving bevel gear 40 is supported axially with a gear holder 21 disposed next to a side portion of the carrier 7. In the drawing, reference numeral 32 stands for an intermediate gear engageable with the gear 6 for transferring the nozzle, reference numeral 41 for a follower bevel gear integrally formed with the intermediate gear 32, reference numeral 44 for a driving gear mounted on an output shaft 57 of the motor 17 for transferring the nozzles, reference numeral 43 for a follower gear engageable with the driving gear 44, and reference numeral 45 for a key for spline-engagement of the driving bevel gear 40 with the spline shaft 22.

By driving the motor 17 for transferring the nozzles in the construction as described hereinabove, the spline shaft 22 is rotated and the driving bevel gear 40 is also rotated. Further, a pair of the gears 6 and 6 for transferring the nozzles are allowed to rotate in the directions opposite to each other to transfer a pair of the nozzles 5 and 5 in the directions in which they come closer to each other or they become separated from each other, more specifically, to transfer the nozzles 5 and 5 in the breadthwise direction of the shoulders of the person P being massaged while lying on the flexible sheet 3 and symmetrically in the left and right directions.

Figure 6:
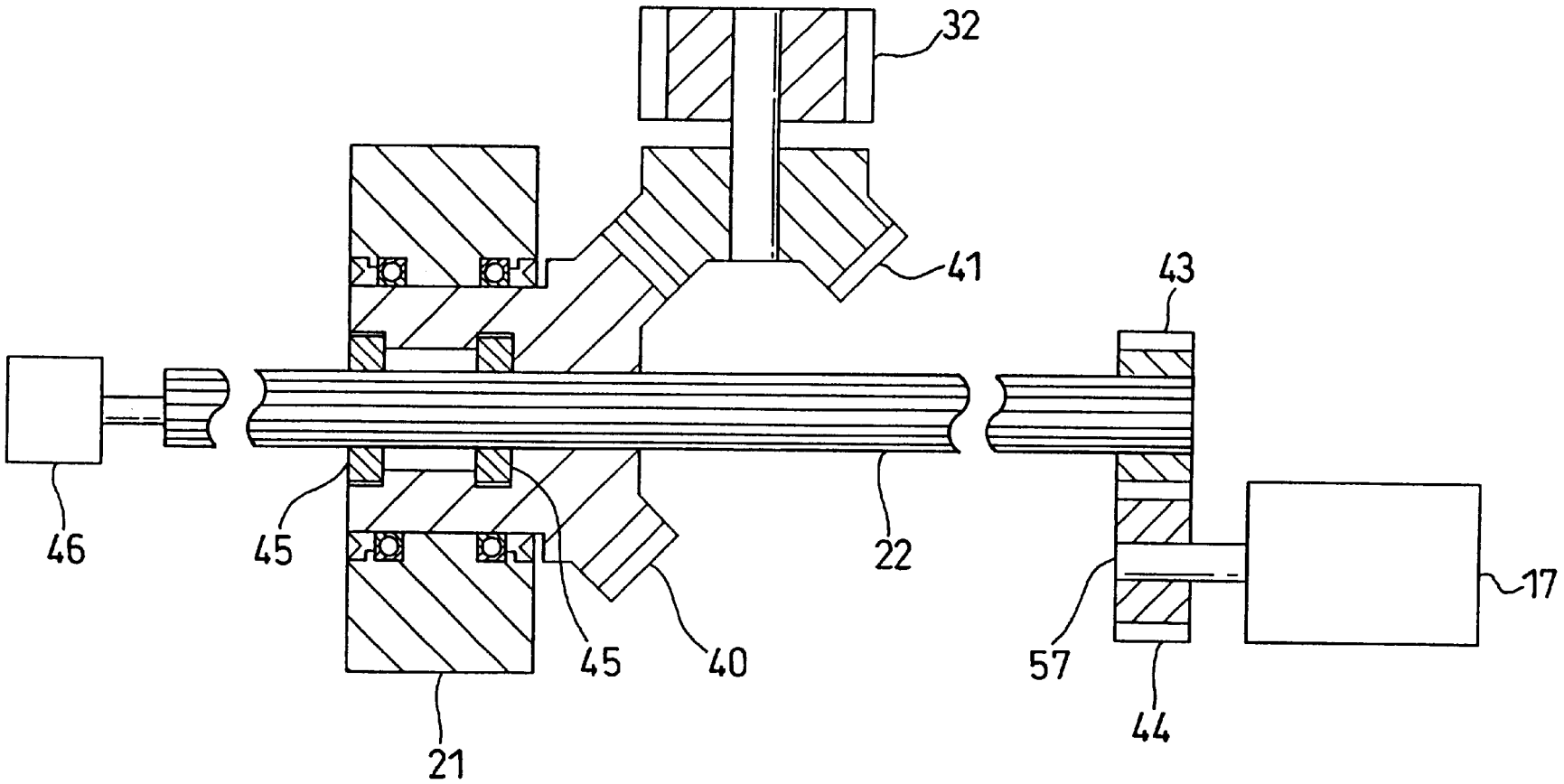
FIG. 6 is a sectional view when taken along line I—I of FIG. 4.

In FIG. 6, reference numeral 46 stands for a potentiometer mounted on a one end of the spline shaft 22 to allow the determination of the positions of the nozzles 5 and 5 by measuring the amount of rotation of the spline shaft 22.

As described hereinabove, the water bed type massaging machine A can offer higher massaging effects by stimulating various locations of the person P being massaged on the areas symmetrically on the left- and right-hand sides in the breadthwise direction of the shoulders with respect to the backbone of the person P being massaged, because the nozzles 5 and 5 are disposed so as to be transferred in a reciprocal manner in the heightwise direction and in the breadthwise direction of the shoulders as well as symmetrically in the left and right directions of the person P being massaged while lying on the flexible sheet 3.

Further, in this embodiment, two pieces of the gears 6 and 6 for transferring the nozzles are used which are equal in size to each other so that the jet device 1 can be constructed in a simple arrangement. Moreover, as the gears 6 and 6 for transferring the nozzles can be made equal in size to each other, the jet device 1 can also be made simple in construction and eventually the water bed type massaging machine A can be assembled in a ready manner and made superior in maintenance.

Then, a description will be made of the construction of mounting the flexible sheet 3.

Figure 7:
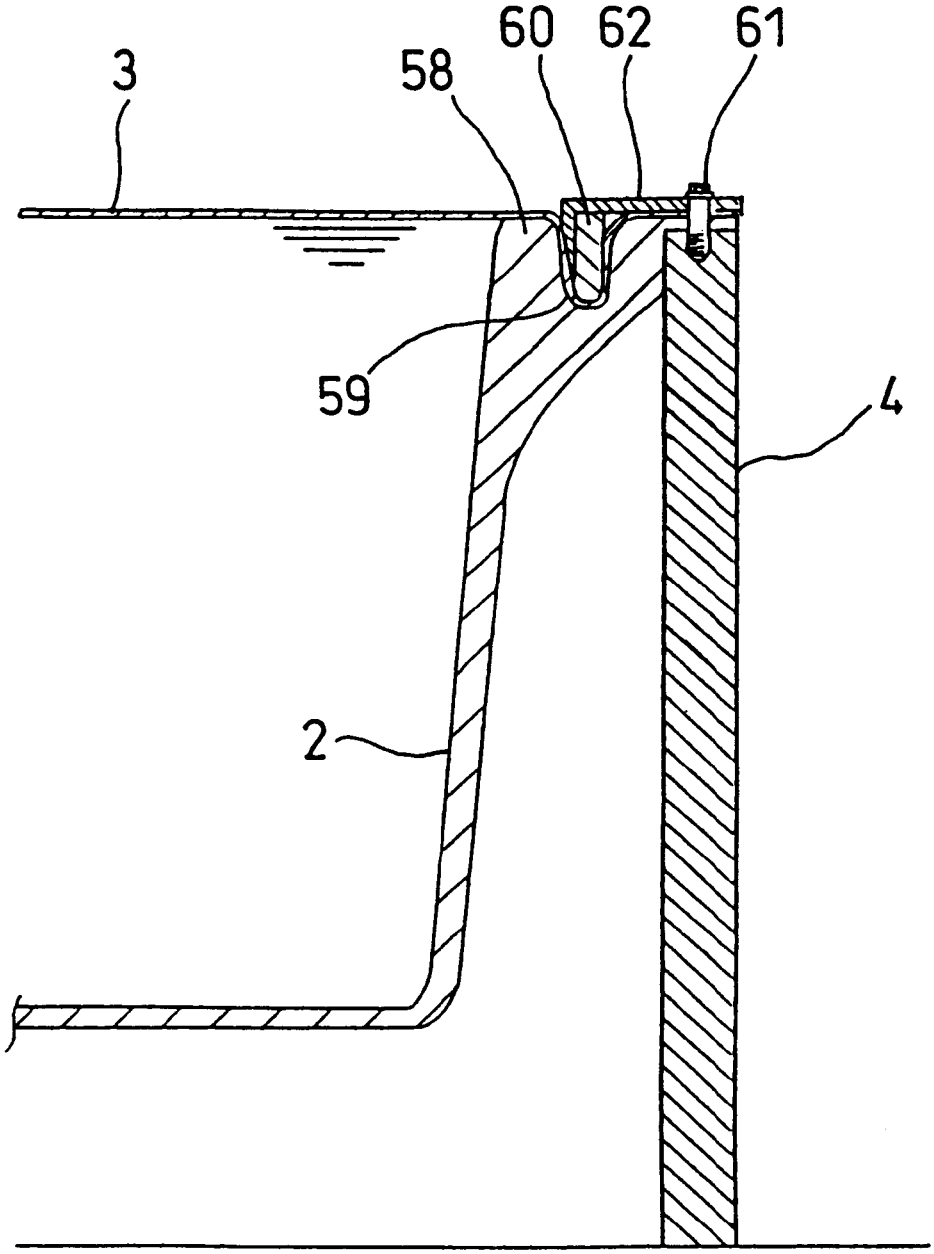
FIG. 7 is a sectional view showing the construction of mounting a sheet.

As shown in FIG. 7, the flexible sheet 3 is disposed to cover the peripheral edge of the opening portion 2*a* of the water container 2. More specifically, the opening portion 2*a* of the water container 2 is formed at its peripheral edge with a flange 58 which is provided with a peripheral groove 59 in which the edge portion of the flexible sheet 3 is once folded and inserted and with which a sealing frame 60 is engaged. The sealing frame 60 is then pressed with a lock plate 62 to allow the fixing of the edge portion of the flexible sheet 3 in the peripheral groove 59. The lock plate 62 is fixed through the flange 58 to a frame 4 with a bolt 61.

With the arrangement as described hereinabove, the water container 2 can hold water and so on therein in a water-tight manner and prevent the water and so on from leaking outside the water container 2.

The flexible sheet 3 is made of a flexible rubber material which is thin and has elasticity so as to comfortably adapt the shape of the body of a person being massaged and it can support the body of the person being massaged in association with the water or the like in the water container 2.

The arrangement of the flexible sheet 3 can provide a comfortable feeling of resting thereon upon lying on the flexible sheet 3 and transmit the pressure of the jet streams from the jet device 1 to the person P being massaged, thereby realizing a comfortable massaging.

Now, a description will be made of the construction of maintaining the temperature of the hot water or the like in the a,water container 2 at an optimal level.

As shown in FIGS. 1 and 2, a side wall 2*d* of the water container 2 is provided with a suction opening 12 and a discharge opening 13, and a suction pump 14 and a radiator 15 are interposed between the suction opening 12 and the discharge opening 13. On the radiator 15 is mounted a cooling fan 63. The side wall 2*c* of the water container 2 is provided with a heater 18. In the drawing, reference numeral 33 stands for a connecting pipe.

Hot water or the like in the water container 2 can be allowed to cool by sucking the hot water or the like from the suction opening 12 with the suction pipe 14, forcibly cooling it with the radiator 15 and the cooling fan 63, and then supplying the cooled water or the like again into the water container 2 from the discharge opening 13. The hot water or the like in the water container 2 can also be warmed with the heater 18.

In this arrangement, a water temperature sensor is disposed in the water container 2 to measure the temperature of the hot water or the like in the water container 2, thereby enabling the temperature of the water or the like in the water container 2 to be maintained always at an optimal level by heating or cooling the water or the like and leading to an increase in massaging effects. As the water or the like in the water container 2 can be sustained at the optimal temperature in the manner as described hereinabove, the person P being massaged while lying on the flexible sheet 3 can enjoy a pleasant feeling because the flexible sheet 3 can be maintained at a temperature that can be perceived by the person P being massaged as being not too hot or too cold.

Further, as the water bed type massaging machine A is arranged such that the hot water or the like in the water container 2 can be cooled even if the temperature of the water or the like therein would be elevated due to a friction of the hot water or the like in the water container 2 caused by the jet streams blown thereinto from the jet device 1, the water bed type massaging machine A can be operated continuously for a long period of time.

In this embodiment, although the hot water or the like in the water container 2 can be cooled with the radiator 15 and the cooling fan 63, it is also possible to cool the hot water or the like in the water container 2 with a pipe mounted in the inside of the water container 2 by passing cooling water through the pipe.

In the water bed type massaging machine A with the above arrangement, as shown in FIGS. 1 and 2, the water bed type massaging machine A is installed with a controller 20 for controlling the operations of the circulating pump 11, the motor 16 for driving a belt, the motor 17 for transferring the nozzles, the suction pump 14 and the heater 18 as well as with an operation panel 26 for operating the controller 20.

In the arrangement as described hereinabove, a variety of controls can be implemented, which may include controls over the pressure of the water to be blown from the nozzles 5 and 5, the positions of the nozzles 5 and 5, and the temperature of the water in the water container 2, among others. In particular, as the water bed type massaging machine A in the above arrangement can provide the person P being massaged with continuously varying stimuli by varying the magnitude of the jet streams blown from the nozzles 5 and 5 periodically or in a random fashion, the water bed type massaging machine A can offer higher massaging effects without allowing the person P being massaged to get used to an action produced by monotonous stimuli.

Therefore, the water bed type massaging machine A can provide a various manner of massaging appropriately in accordance with situations and preferences of the person P being massaged (referring to FIGS. 21 to 27).

Figure 21:
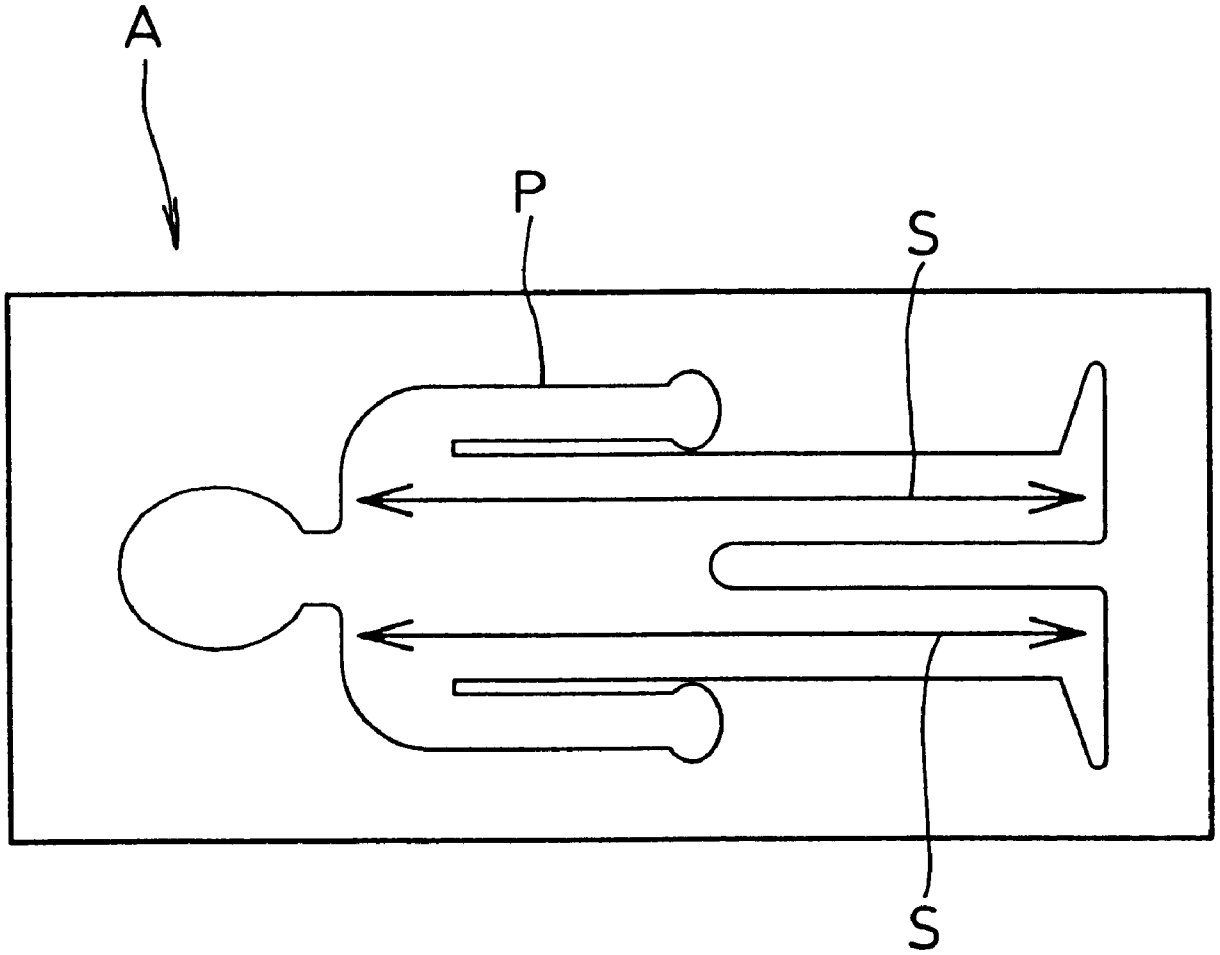
FIG. 21 is a view for describing loci of massaging locations when nozzles are transferred in a reciprocal way in the heightwise direction of a person being massaged.

FIG. 21 shows loci S of the massaging locations obtained when the nozzles 5 and 5 are transferred in a reciprocal manner in the heightwise direction of the person P being massaged. In this case, only the carrier 7 is transferred reciprocally in the heightwise direction of the person P being massaged. As shown in FIG. 21, this way of massaging enables jet streams blown from the nozzles 5 and 5 to provide stimuli onto effective spots for effectively producing stimuli, which are present over a wide area extending continually from the head to the feet of the person P being massaged.

Figure 22:
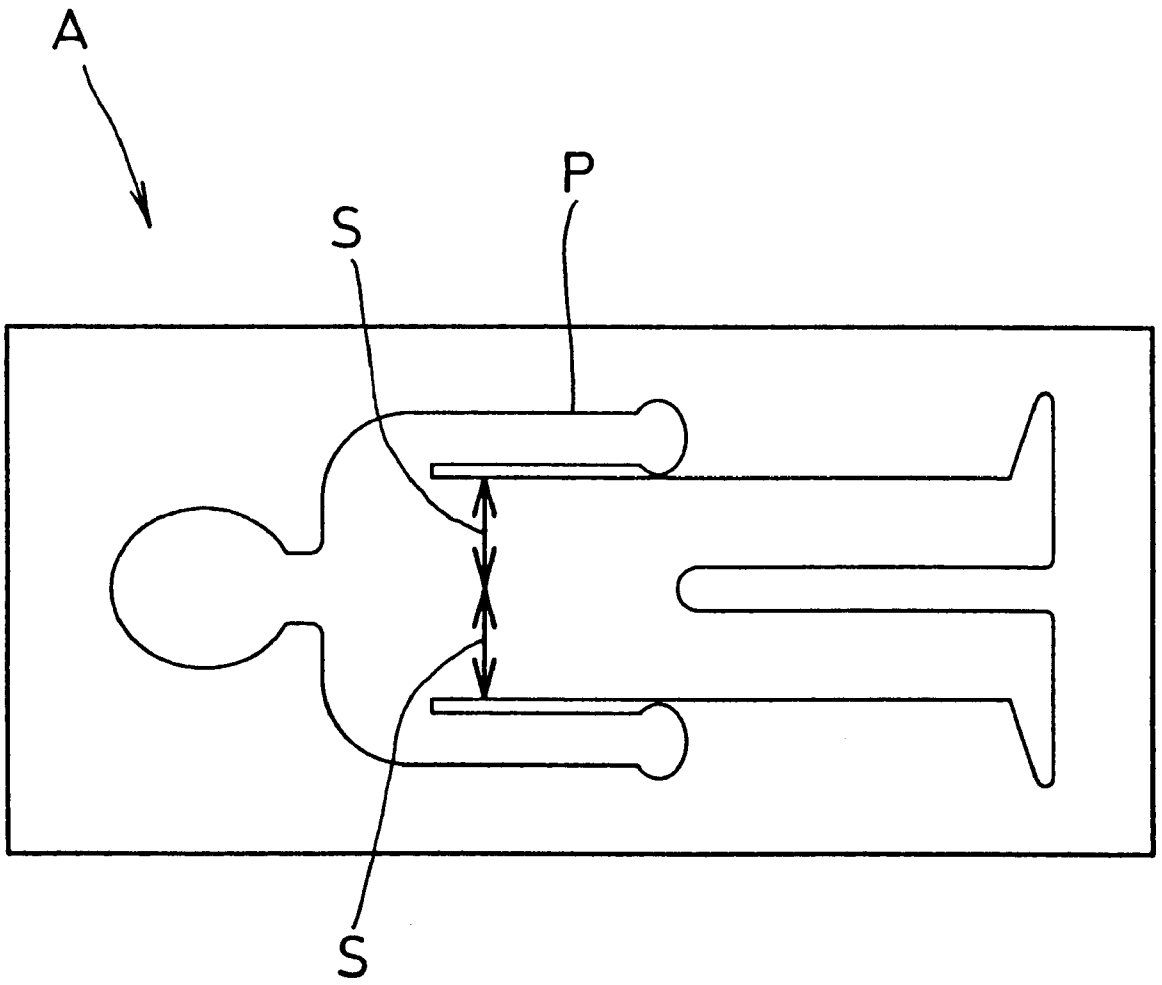
FIG. 22 is a view for describing loci of massaging locations when nozzles are transferred in a reciprocal way in the breadthwise direction of the shoulders of a person being massaged.

FIG. 22 indicates loci S of massaging locations when the nozzles 5 and 5 are transferred in a reciprocal way in the breadthwise direction of the shoulders of the person P being massaged. In this case, the carrier 7 is transferred in an appropriate way in the heightwise direction of the person P being massaged to transfer the nozzles 5 and 5 reciprocally in a straight way in the heightwise direction of the person P being massaged, the nozzles 5 and 5 being transferred in an arc-shaped manner by the rotation of the gears 6 and 6 for transferring the nozzles. Then, as shown in FIG. 22, jet streams blown from the nozzles 5 and 5 stimulate a variety of effective spots of the person P being massaged for effectively producing stimuli, which are present continually on the left-hand and right-hand sides with the backbone of the person P being massaged centered therebetween.

Figure 23:
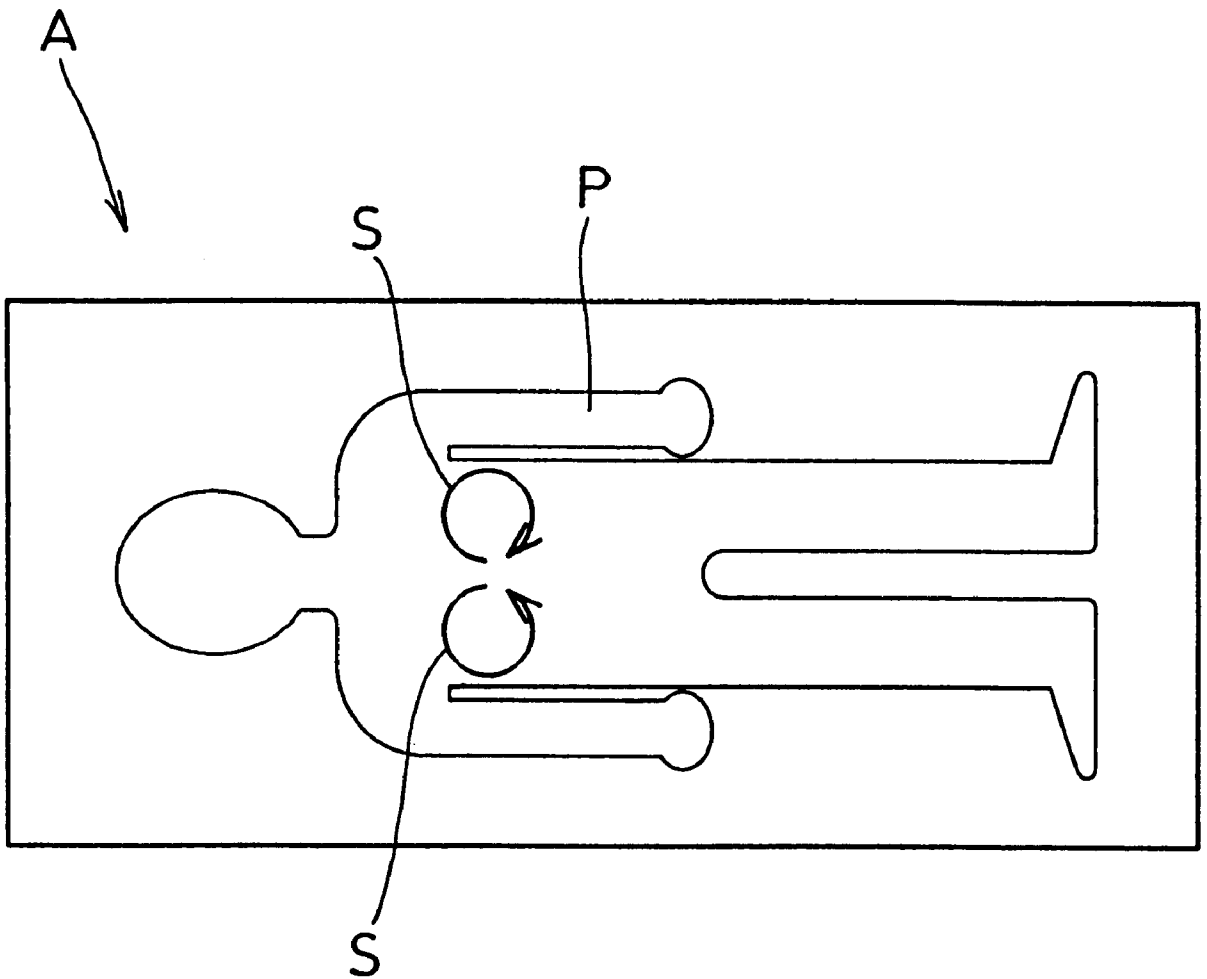
FIG. 23 is a view for describing loci of massaging locations when nozzles are rotated.

FIG. 23 illustrates loci S of massaging locations when the nozzles 5 and 5 are rotated. In this case, only the gears 6 and 6 for transferring the nozzles are rotated at given locations of the person P being massaged. Further, as shown in FIG. 23, jet streams blown from the nozzles 5 and 5 are designed so as to provide stimulation around effective spots for effectively producing comfortable stimuli as if massaging by hands, the effective spots being present on the back of the person P being massaged.

Figure 24:
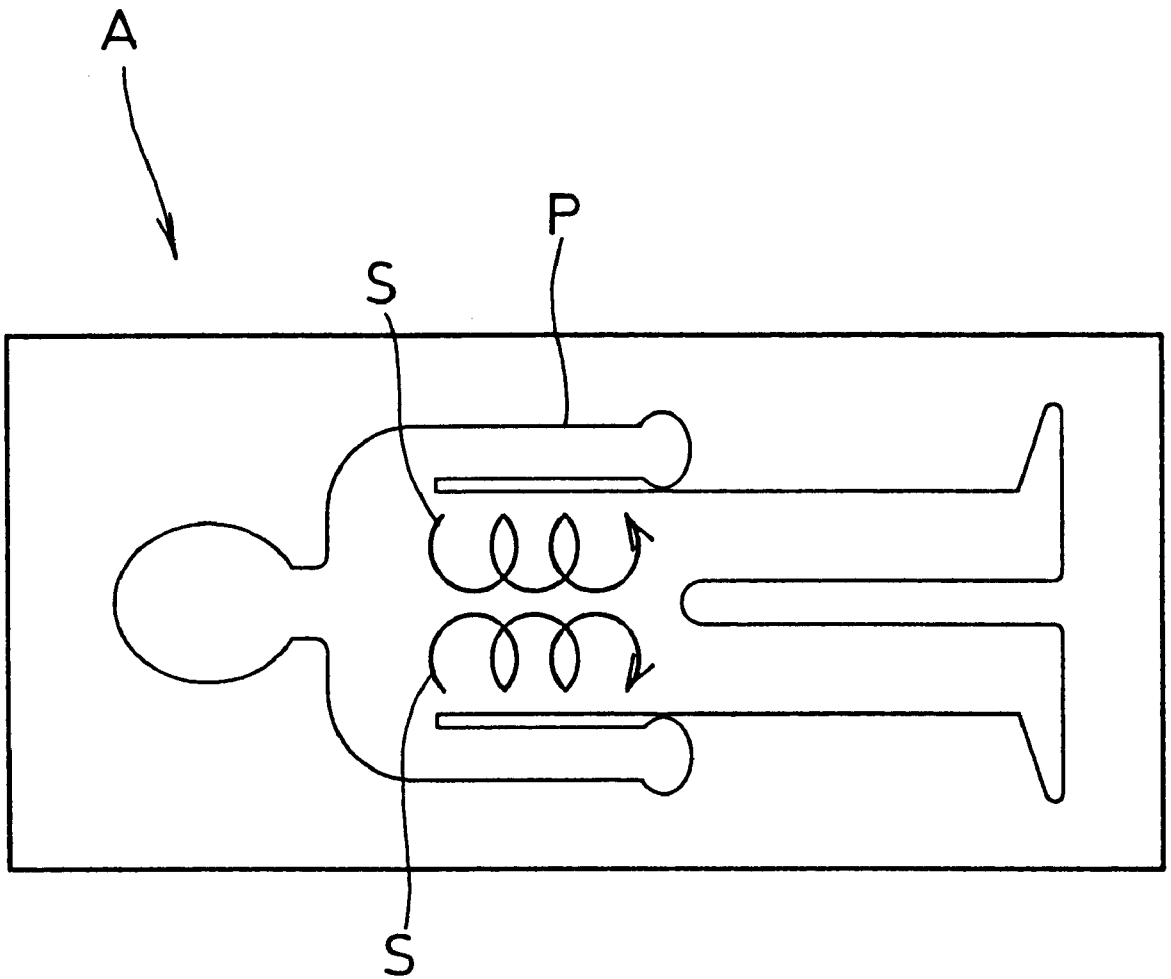
FIG. 24 is a view for describing loci of massaging locations when nozzles are transferred in the heightwise direction of a person being massaged while rotating the nozzles.

FIG. 24 shows loci S of the massaging locations when the nozzles 5 and 5 are transferred in the heightwise direction of the person P being massaged while rotating the nozzles 5 and 5. In this case, the carrier 7 is transferred in the heightwise direction of the person P being massaged while rotating the gears 6 and 6 for transferring the nozzles. As shown in FIG. 24, jet streams blown from the nozzles 5 and 5 are designed so as to stimulate as a whole effective spots for effectively producing comfortable stimuli, the effective spots being present on the back of the person P being massaged.

Figure 25:
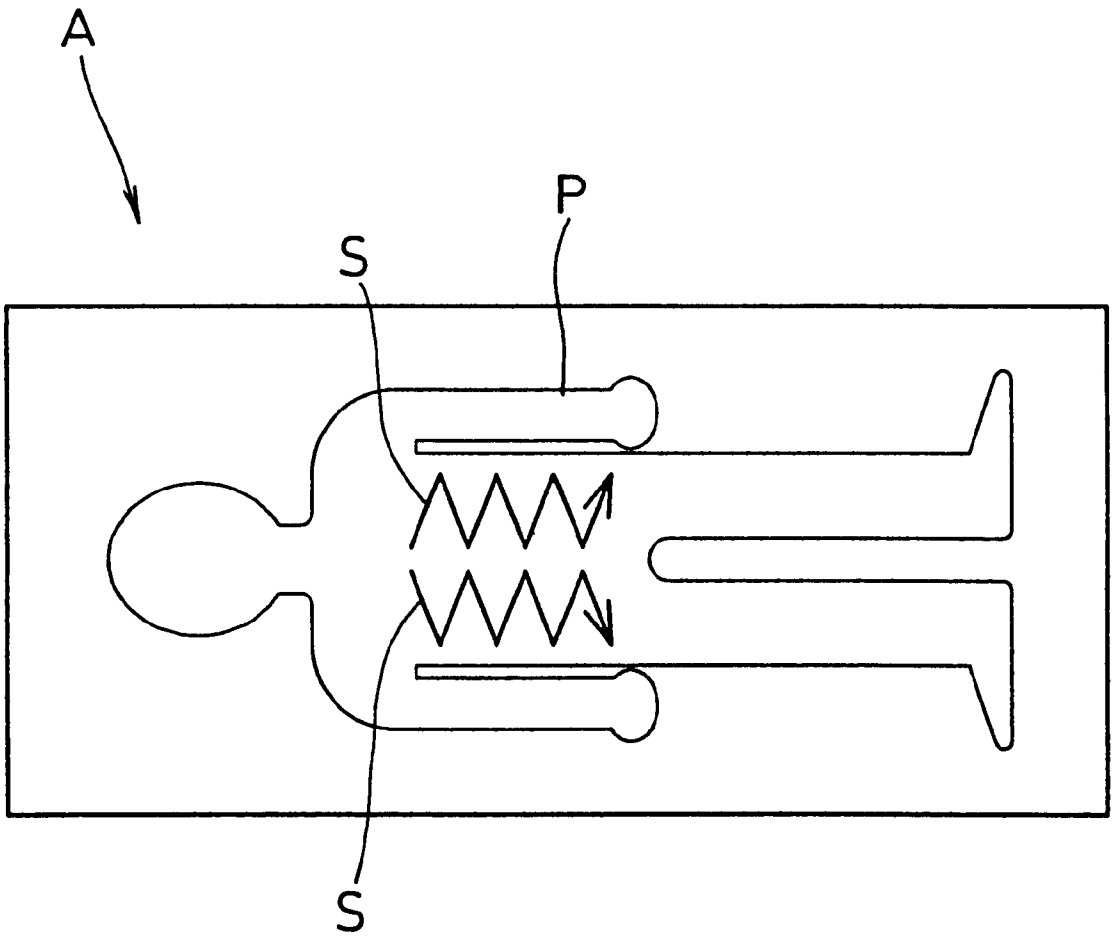
FIG. 25 is a view for describing loci of massaging locations when nozzles are transferred in the heightwise direction of the person being massaged while transferring the nozzles reciprocally in the breadthwise direction of the shoulders of the person being massaged.

FIG. 25 indicates loci S of massaging locations when the nozzles 5 and 5 are transferred in the heightwise direction of the person P being massaged while transferring the nozzles 5 and 5 reciprocally in the breadthwise direction of the shoulders of the person. In this case, the carrier 7 is transferred in an appropriate way in the heightwise direction of the person P being massaged in order to transfer the nozzles 5 and 5 in the heightwise direction of the person P being massaged, too, while reciprocally transferring them in a linearly straight manner in the breadthwise direction of the shoulders of the person, the nozzles 5 and 5 being in an arc-shaped way by the rotation of the gears 6 and 6 for transferring the nozzles. Further, in this case, as shown in FIG. 25, a variety of effective spots for effectively providing comfortable stimuli can be stimulated as a whole by jet streams blown from the nozzles 5 and 5, the effective spots being present continually on the both light-hand and right-hand sides of the person P being massaged with respect to the backbone of the person P being massaged.

Figure 26:
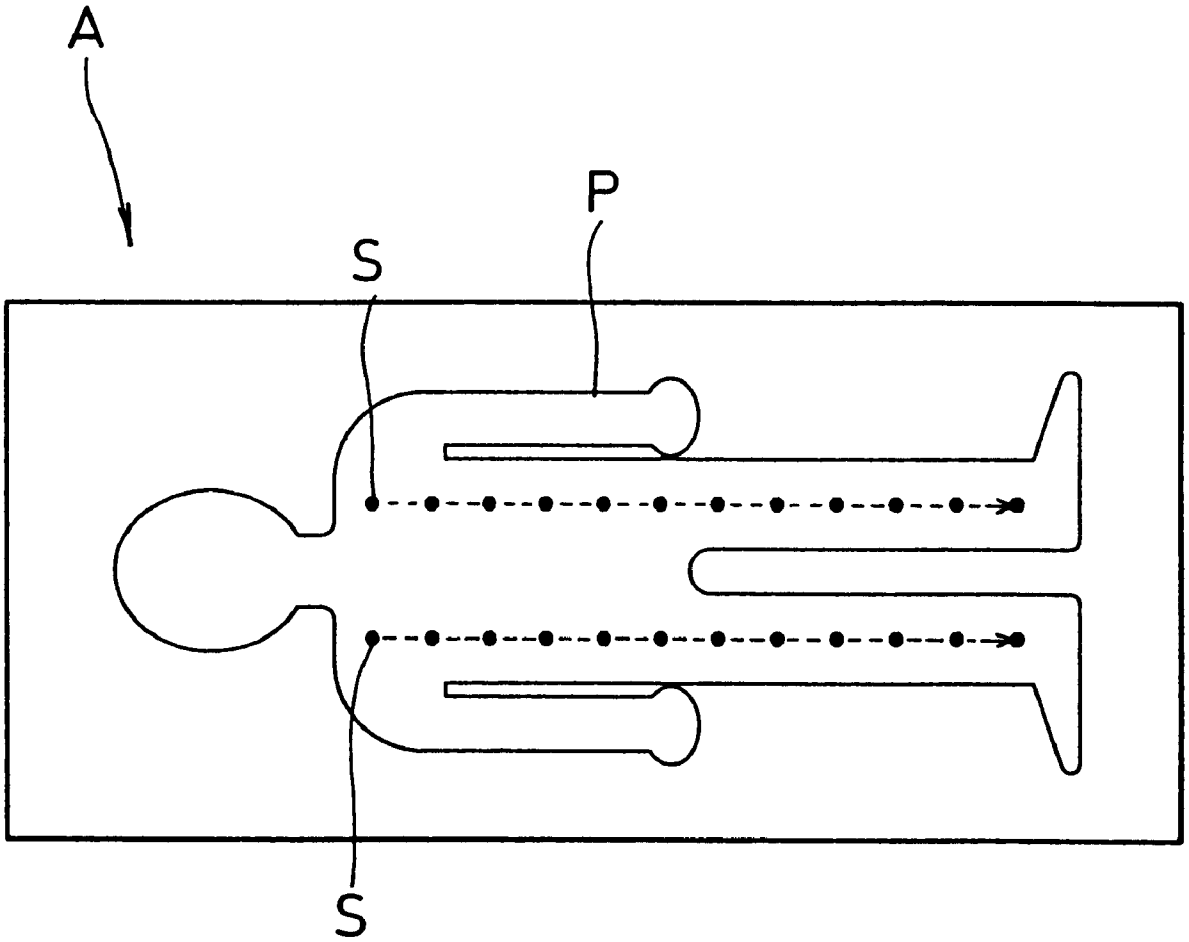
FIG. 26 is a view for describing loci of massaging locations when jet streams are blown intermittently from nozzles while transferring the nozzles in the heightwise direction of the person being massaged.

FIG. 26 illustrates loci S of massaging locations when jet streams are blown intermittently from the nozzles 5 and 5 while transferring the nozzles 5 and 5 in the heightwise direction of the person P being massaged. In this case, the circulating pump 11 is operated intermittently while only the carrier 7 is being transferred in the heightwise direction of the person P being massaged. As shown in FIG. 26, in this case, the jet streams blown from the nozzles 5 and 5 can stimulate a variety of effective spots for effectively producing comfortable stimuli in a direct and concentrated way, the effective spots being present in the area extending from the head portion to the feet portion of the person P being massaged.

On the other hand, the person P being massaged may become getting used to stimuli when the stimuli are monotonous and such monotonous stimuli are provided continuously to the person P being massaged. Like in this case, however, when stimuli are provided intermittently to the person P being massaged, the person can be prevented from having getting used to such stimuli. Moreover, when a magnitude of blowing jet streams or an interval of blowing jet streams from the nozzles 5 and 5 is varied in a random manner, continuously varying stimuli are given the person P being massaged. This can enhance massaging effects to a higher level without causing the person P being massaged to become getting used to such stimuli.

Figure 27:
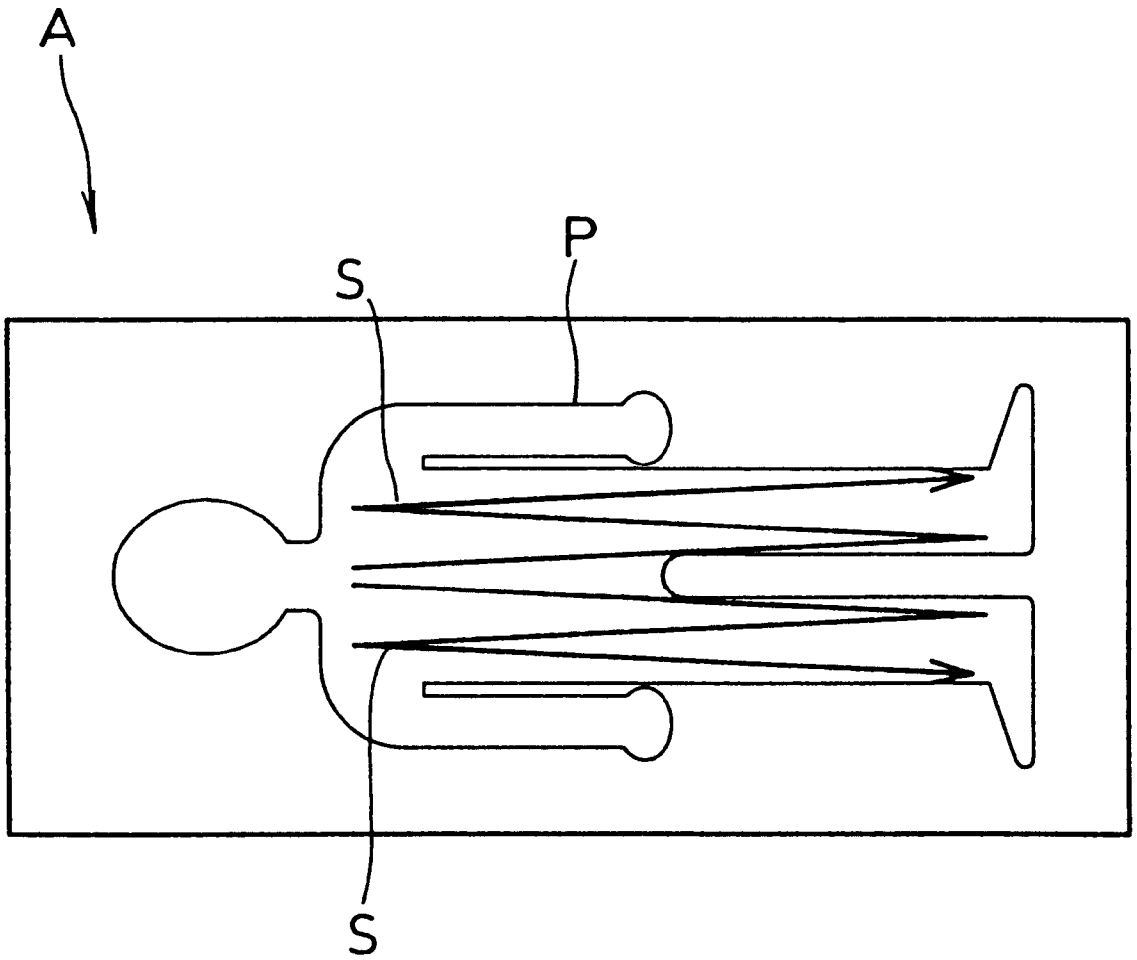
FIG. 27 is a view for describing loci of massaging locations when nozzles are transferred in the breadthwise direction of the shoulders of the person being massaged, too, while transferring them reciprocally in the heightwise direction of the person being massaged.

FIG. 27 shows loci S of massaging locations when the nozzles 5 and 5 are transferred in the breadthwise direction of the shoulders of the person P being massaged, too, while transferring them reciprocally in the heightwise direction of the person. This case of massaging is carried out by rotating the gears 6 and 6 for transferring the nozzles after the carrier 7 has been transferred in the heightwise direction of the person P being massaged, and then transferring the carrier 7 in the heightwise direction of the person being massaged. As shown in FIG. 27, in this case, jet streams blown from the nozzles 5 and 5 can stimulate a variety of effective spots for effectively producing comfortable stimuli present over the back of the person P being massaged as a whole.

The water bed type massaging machine A can stimulate a variety of effective spots for effectively producing comfortable and pleasant stimuli present over the back of the person P being massaged by jet streams blown from the nozzles 5 and 5 in the manner as described hereinabove. Likewise, it can provide comfortable and pleasant stimuli to the light-hand and right-hand sides of the person P being massaged symmetrically with respect to the backbone of the person P being massaged. Thus, it can produce higher massaging effects.

Now, a description will be made of another embodiment of the jet device 1.

Figure 8:
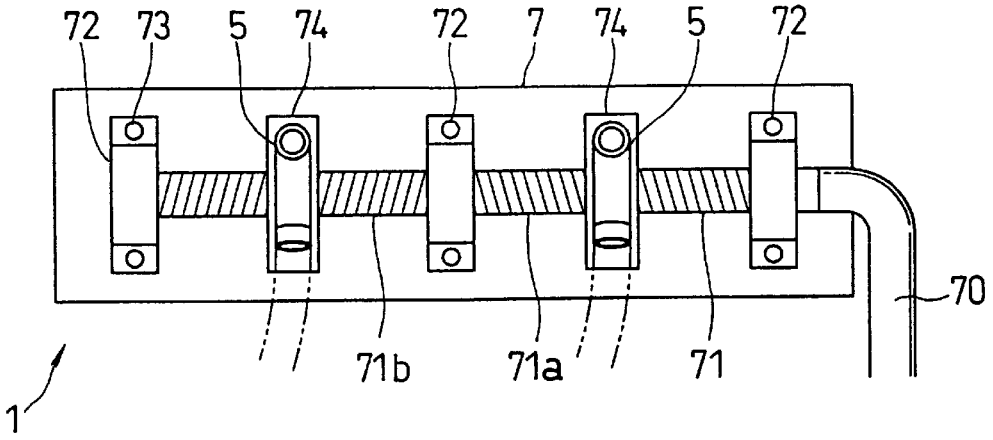
FIG. 8 is a plan view showing a jet device according to another embodiment of the present invention.
Figure 9:
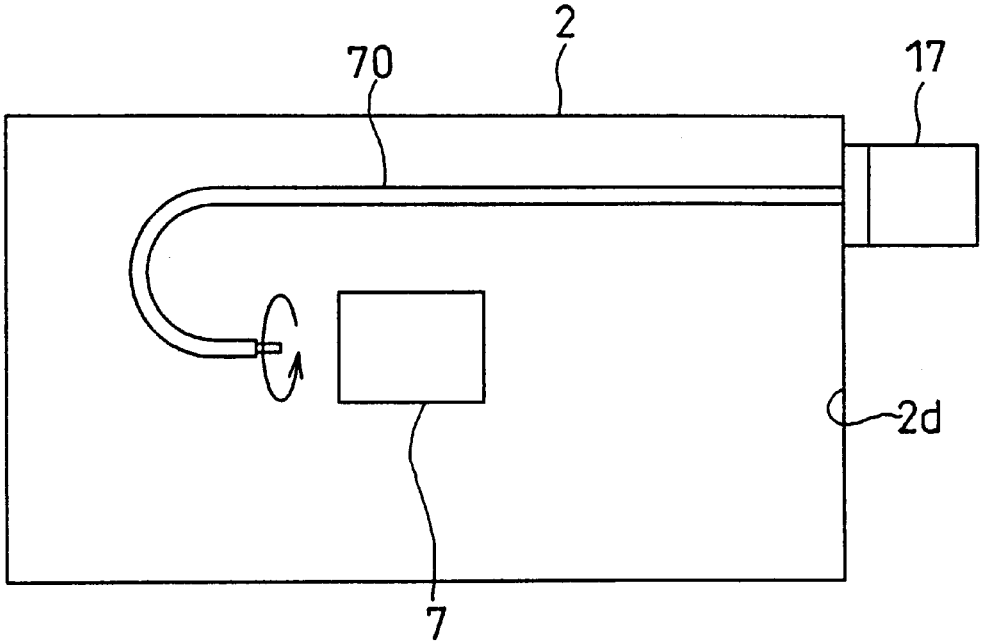
FIG. 9 is a plan view showing a mechanism for transferring a jet device according to the another embodiment of the present invention.

FIGS. 8 and 9 illustrate a jet device according to a second embodiment of the present invention. In the second embodiment, the jet device 1 has a nozzle transferring shaft 71 disposed on top of the carrier 7 so as to be rotatable, a right-hand screw thread 71*a* formed on an outer peripheral right-hand side surface of the nozzle transferring shaft 71, and a left-hand screw thread 71*b* formed on an outer peripheral left-hand side surface thereof said jet and the right-hand and left-hand screw threads 71*a* and 71*b* thread nozzle transferring members 74 and 74 fixed to the nozzles 5 and 5, respectively. In the drawings, reference numeral 72 stands for a shaft support member with the nozzle transferring shaft 71 inserted therethrough rotatably and reference numeral 73 for a mounting vis.

A one edge portion of the nozzle transferring shaft 71 is connected to a flexible shaft 70 so as to be associated therewith. The flexible shaft 70 is coupled with and associated with the motor 17 for transferring the nozzles disposed on the back side of the side wall 2*d* of the water container 2 so as to transmit the power of the motor 17 for transferring the nozzles to the jet device 1 within the water container 2.

In the arrangement of the construction as described hereinabove, the nozzle transferring shaft 71 is rotated via the flexible shaft 70 by driving the motor 17 for transferring the nozzles, thereby transferring a pair of the nozzles 5 and 5 in the directions in which they come closer to each other or they are separated apart from each other, in other words, in the breadthwise direction of the shoulders of the person P being massaged while lying on the flexible sheet 3.

Figure 10:
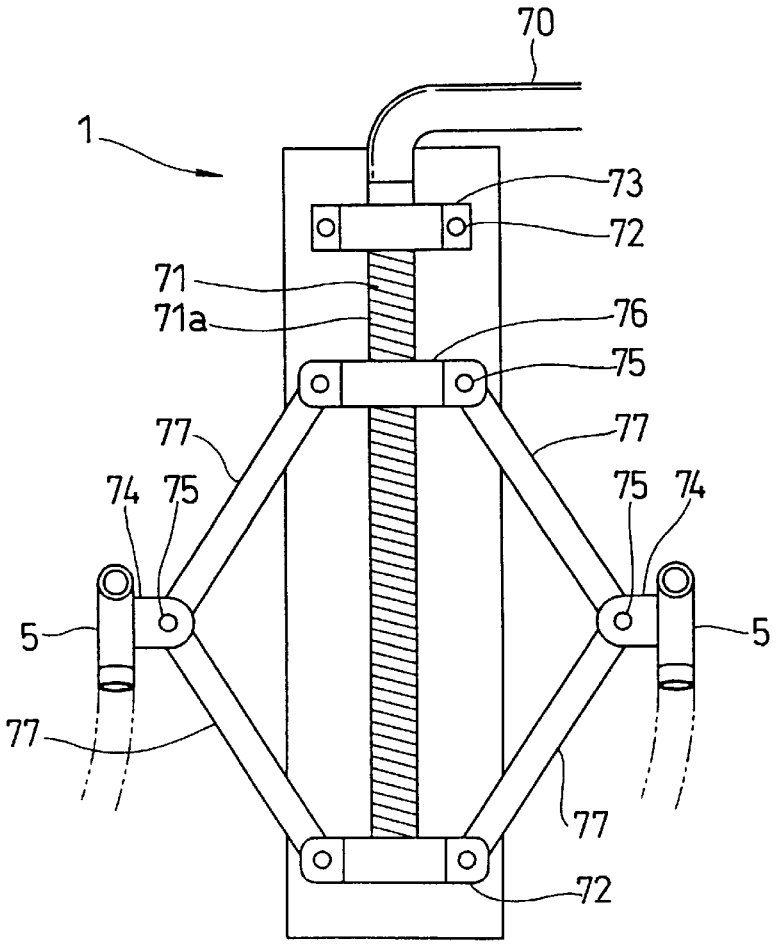
FIG. 10 is a plan view showing a jet device according to an other embodiment of the present invention.

FIG. 10 shows a jet device according to a third embodiment of the present invention. In this embodiment, the jet device 1 has a nozzle transferring shaft 71 disposed on top of the carrier 7 so as to be rotatable and a right-hand screw thread 71*a* formed on an outer peripheral side surface of the nozzle transferring shaft 71, and a moving member 76 is screwed with the right-hand screw thread 71*a*. The moving member 76 and a shaft support member 72 fixed to an edge portion of the carrier 7 are connected to a pair of light-hand and right-hand connecting members 77 and 77 via a nozzle transferring member 74 with each of the nozzles 5 and 5 fixed thereto. A one edge portion of the nozzle transferring shaft 71 is coupled with and associated with a flexible shaft 70 having a construction similar to the flexible shaft 70 in the second embodiment as described hereinabove. In the drawing, reference numeral 72 stands for a shaft support member with the nozzle transferring shaft 71 inserted rotatably therethrough, reference numeral 73 for a mounting vis, and reference numeral 75 for a connecting pin.

In the above arrangement, driving the motor 17 for transferring the nozzles rotates the nozzle transferring shaft 71 via the flexible shaft 70 and transfers the moving member 76 along the nozzle transferring shaft 71, thereby transferring a pair of the nozzle transferring members 74 and 74 and the nozzles 5 and 5 via the connecting members 77 and 77, respectively, in the directions in which they come closer to each other or they are separated apart from each other, that is, in the breadthwise direction of the shoulders of the person P being massaged while lying on the flexible sheet 3.

Figure 11:
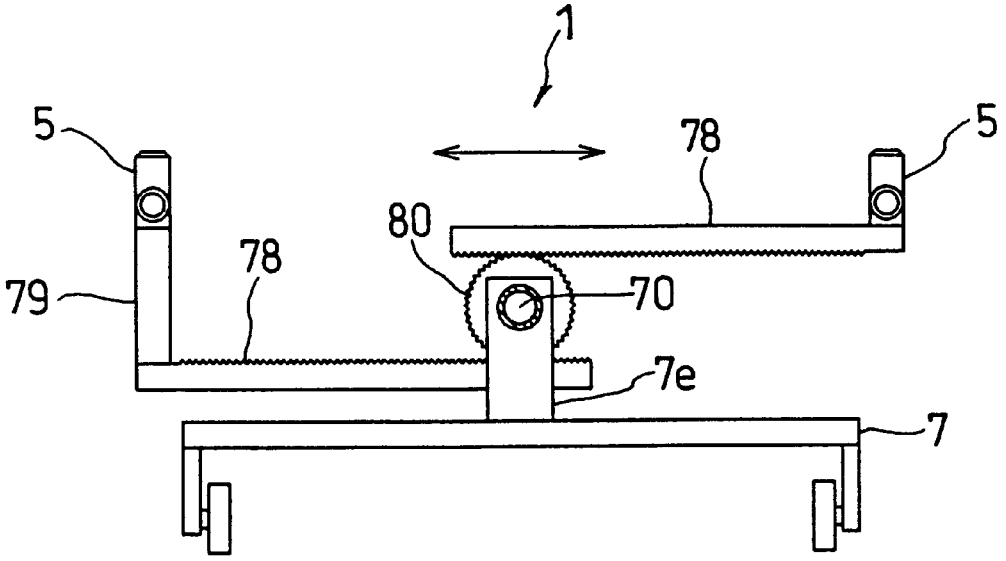
FIG. 11 is a plan view showing a jet device according to an other embodiment of the present invention.

FIG. 11 indicates a jet device according to a fourth embodiment of the present invention. In this embodiment, the jet device 1 has a shaft support member 7*e* disposed upstanding on top of the carrier 7 and a flexible shaft 70 inserted through the shaft support member 74, which has a construction similar to the flexible shaft 70 as in the second embodiment as described hereinabove. To a topside end of the flexible shaft 70 is connected a pinion gear 80 so as to be associated therewith. A pair of rack gears 78 and 78 are coupled with the pinion gear 80 mounted on top of the carrier 7 so as to be associated with the pinion gear 80, and the rack gears 78 and 78 are provided with the respective nozzles 5 and 5. In the drawing, reference numeral 79 stands for a secondary support member disposed so as to make a pair of the nozzles 5 and 5 equal to each other in height.

In this arrangement, the pinion gear 80 is rotated via the flexible shaft 70 by driving the motor 17 for transferring the nozzles, thereby transferring the rack gears 78 to the left and the right, respectively, so that a pair of the nozzles 5 and 5 are transferred in the directions in which they come closer together or they are separated apart from each other, that is, in the breadthwise direction of the shoulders of the person P being massaged while lying on the flexible sheet 3.

Figure 13:
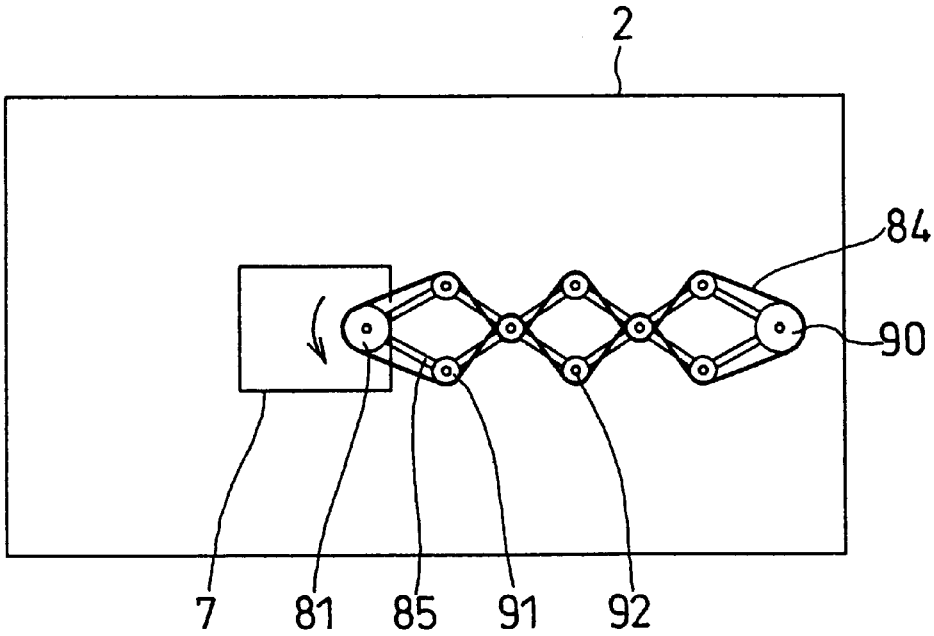
FIG. 13 is a plan view showing a mechanism for transferring the jet device according to the other embodiment of the present invention.
Figure 12:
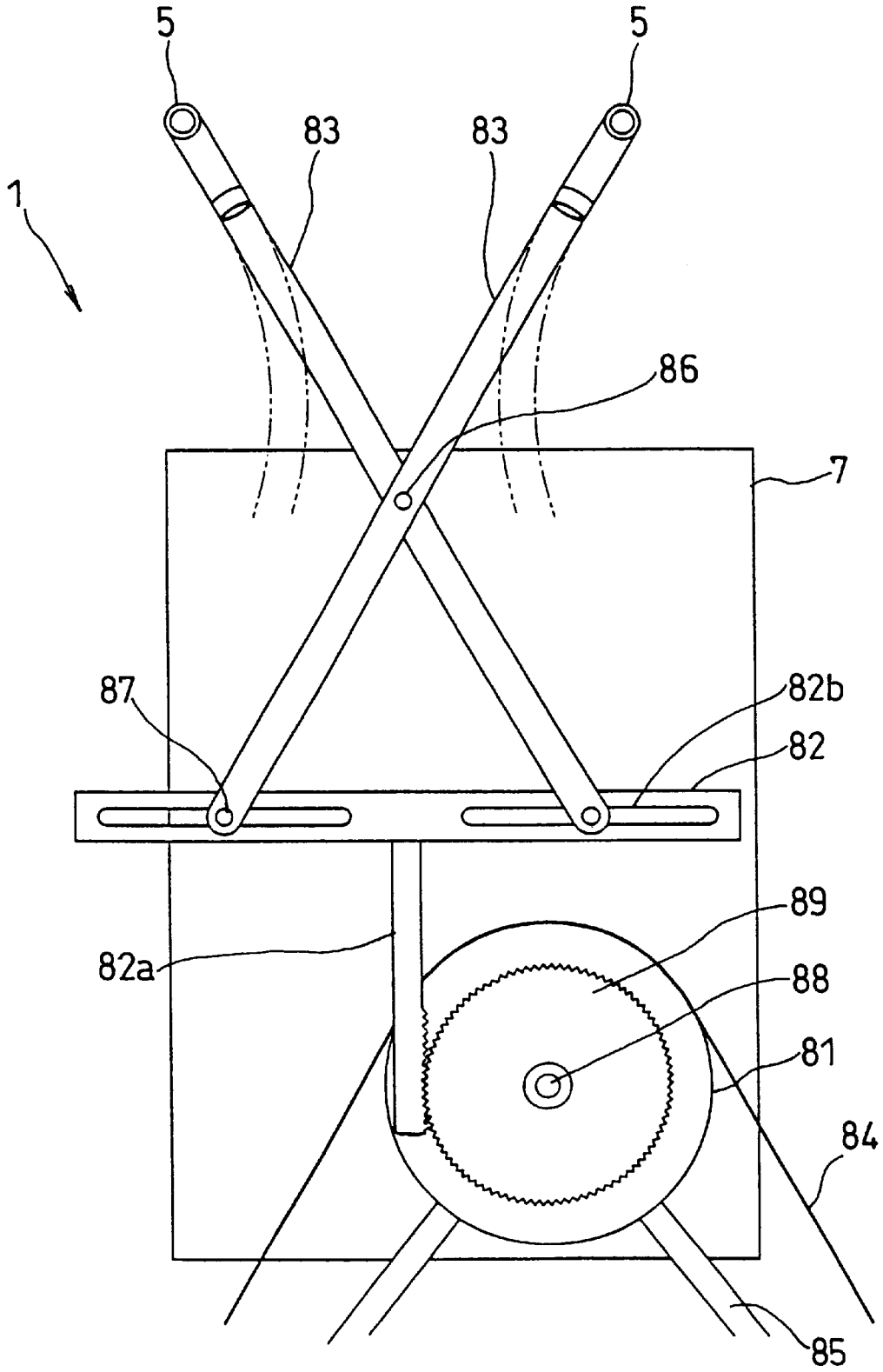
FIG. 12 is a plan view showing a jet device according to an other embodiment of the present invention.

FIGS. 12 and 13 illustrate a jet device according to a fifth embodiment of the present invention. In this embodiment, the jet device 1 has a follower pulley 81 for transferring a nozzle supported axially on top of the carrier 7 and a pinion gear 89 connected coaxially thereto and associated therewith on top of the nozzle-transferring follower pulley 81. To the pinion gear 89 are connected nozzle transferring members 83 and 83 with the nozzles 5 and 5 mounted thereon each at a topside edge thereof so as to be associated therewith. More specifically, the pinion gear 89 is screwed with a rack gear 82*a* to a topside edge of which is connected a connecting member 82. The connecting member 82 is formed with guide holes 82*b* and 82*b* directed horizontally and connected slidably to the respective base ends of the nozzle transferring members 83 and 83. The nozzle transferring members 83 and 83 are disposed crossing each other in their middle positions and connected at their topside ends to the nozzles 5 and 5, respectively. In the drawings, reference numeral 86 stands for a shaft and reference numeral 87 for a connecting pin.

FIG. 13 shows a mechanism for rotating the nozzle-transferring follower pulley 81. The water container 2 is disposed at a right-hand edge portion thereof with a drive pulley 90 for transferring the nozzle, which in turn is connected to the nozzle-transferring follower pulley 81 with a connecting member 85 connected rotatably through a pin 92. On the pin 92 is further mounted a tension pulley 91 so as to be rotatable, and an endless timing belt 84 is wound on the tension pulley 91, the nozzle-transferring drive pulley 90 and the nozzle-transferring follower pulley 81. The nozzle-transferring drive pulley 90 is coupled with the motor 17 for transferring the nozzles at a lower portion of the water container 2 so as to be associated with each other, although not shown, thereby allowing the power of the motor 17 for transferring the nozzles to be transmitted to the jet device 1 within the water container 2.

In the arrangement of the construction as described hereinabove, driving the motor 17 for transferring the nozzles rotates the nozzle-transferring follower pulley 81 through the timing belt 84 to transfer a pair of the nozzles 5 and 5 in the directions in which they come closer to each other or they are separated apart from each other, that is, in the breadthwise direction of the shoulders of the person P being massaged while lying on the flexible sheet 3.

Figure 14:
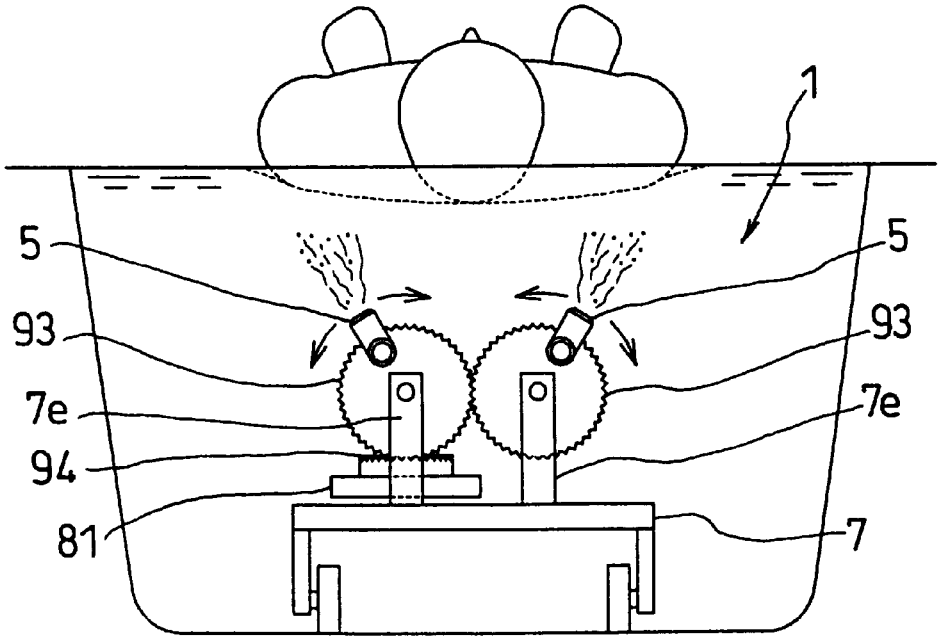
FIG. 14 is a plan view showing a jet device according to an other embodiment of the present invention.
Figure 15:
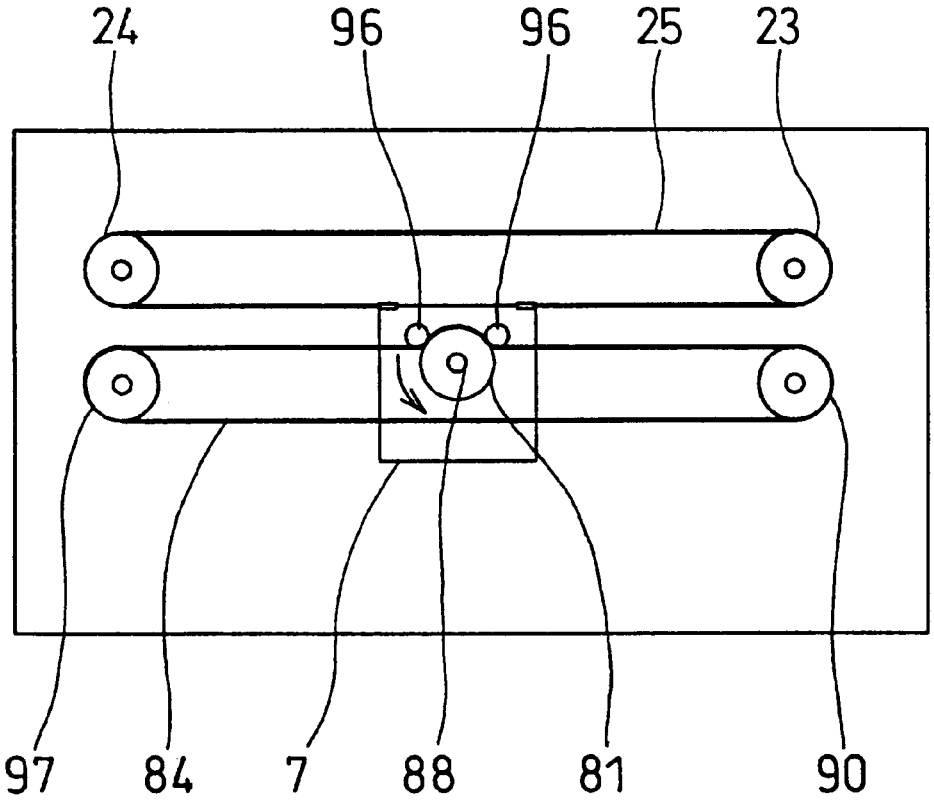
FIG. 15 is a plan view showing a mechanism for transferring the jet device according to the other embodiment of the present invention.

FIGS. 14 and 15 illustrate a jet device according to a sixth embodiment of the present invention. In this embodiment, the jet device 1 has shaft support members 7*e* and 7*e* disposed upstanding on top of the carrier 7 and a pair of gears 93 and 93 for transferring nozzles supported axially each in an engaged state to the shaft support members 7*e* and 7*e*, each of the gears 93 and 93 being fixed with the nozzles 5 and 5, respectively. On top of the carrier 7 is disposed a follower pulley 81 for transferring the nozzle so as to be rotatable, and the nozzle-transferring follower pulley 81 is connected coaxially to a gear 94 for transferring a nozzle, which in turn is toothed with the respective nozzle-transferring gear 93. In the drawings, reference numeral 88 stands for a rotary shaft.

FIG. 15 illustrates a mechanism for rotating the nozzle-transferring follower pulley 81. The water container 2 is disposed at a right-hand edge portion thereof with the nozzle-transferring drive pulley 90 and at a left-hand edge portion thereof with a follower pulley 97, and an endless timing belt 84 is wound about the pulleys 90 and 97. The timing belt 84 is coupled with and associated with the nozzle-transferring follower pulley 81, and the nozzle-transferring drive pulley 90 is coupled with and associated with the motor 17 for transferring the nozzles disposed at the lower portion of the water container 2. This arrangement allows the power of the motor 17 for transferring the nozzles to be transmitted to the jet device 1 within the water container 2. In the drawing, reference numeral 96 stands for a tension pulley.

In this arrangement as described hereinabove, the nozzle-transferring follower pulley 81 is rotated via the timing belt 84 by driving the motor 17 for transferring the nozzles to transfer a pair of the nozzles 5 and 5 in the directions in which they come closer to each other or they part from each other, that is, in the breadthwise direction of the shoulders of the person P being massaged while lying on the flexible sheet 3.

Figure 16:
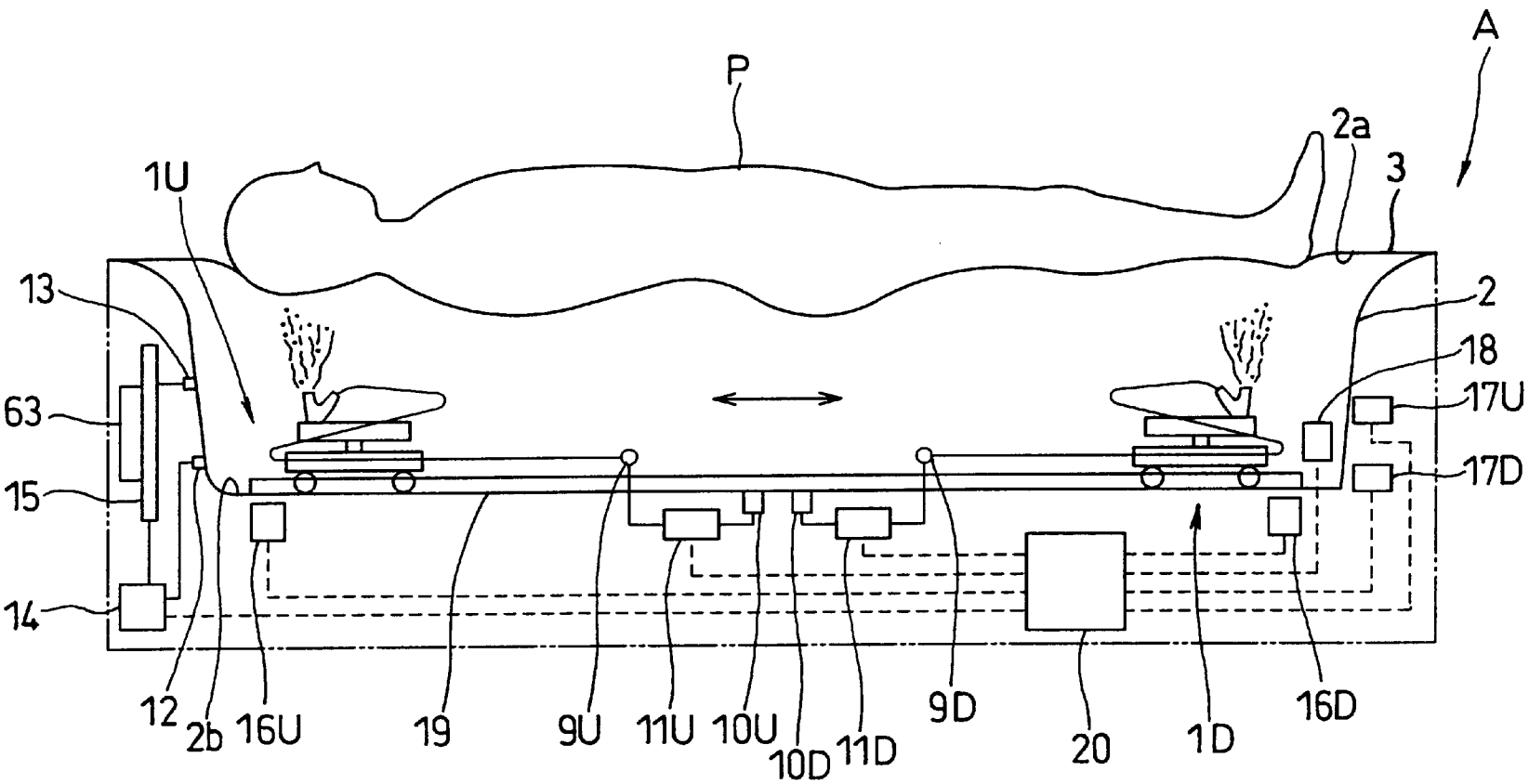
FIG. 16 is a side view for describing a water bed type massaging machine according to an other embodiment of the present invention.
Figure 17:
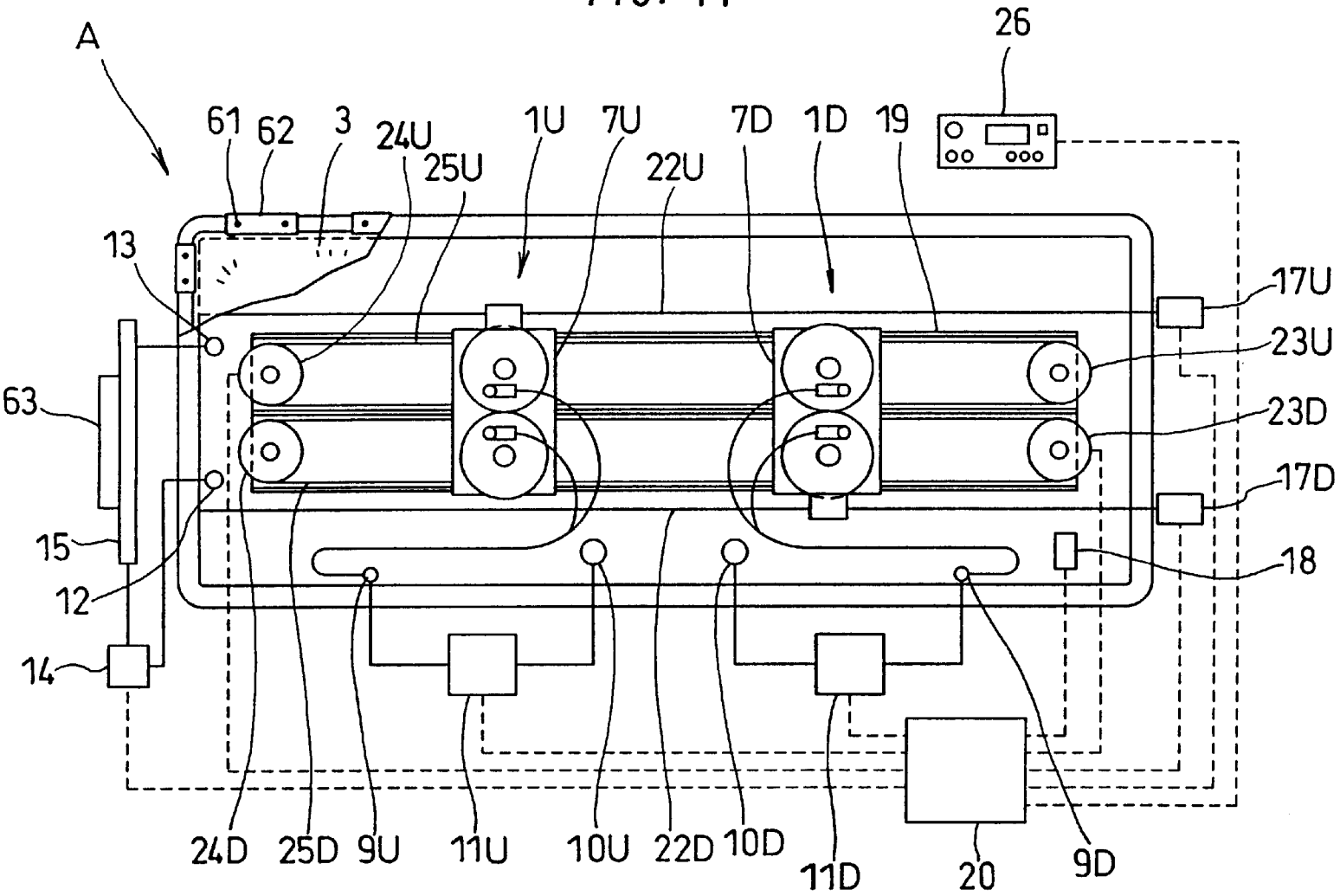
FIG. 17 is a plan view for describing the jet device according to the other embodiment of the present invention.
Figure 18:
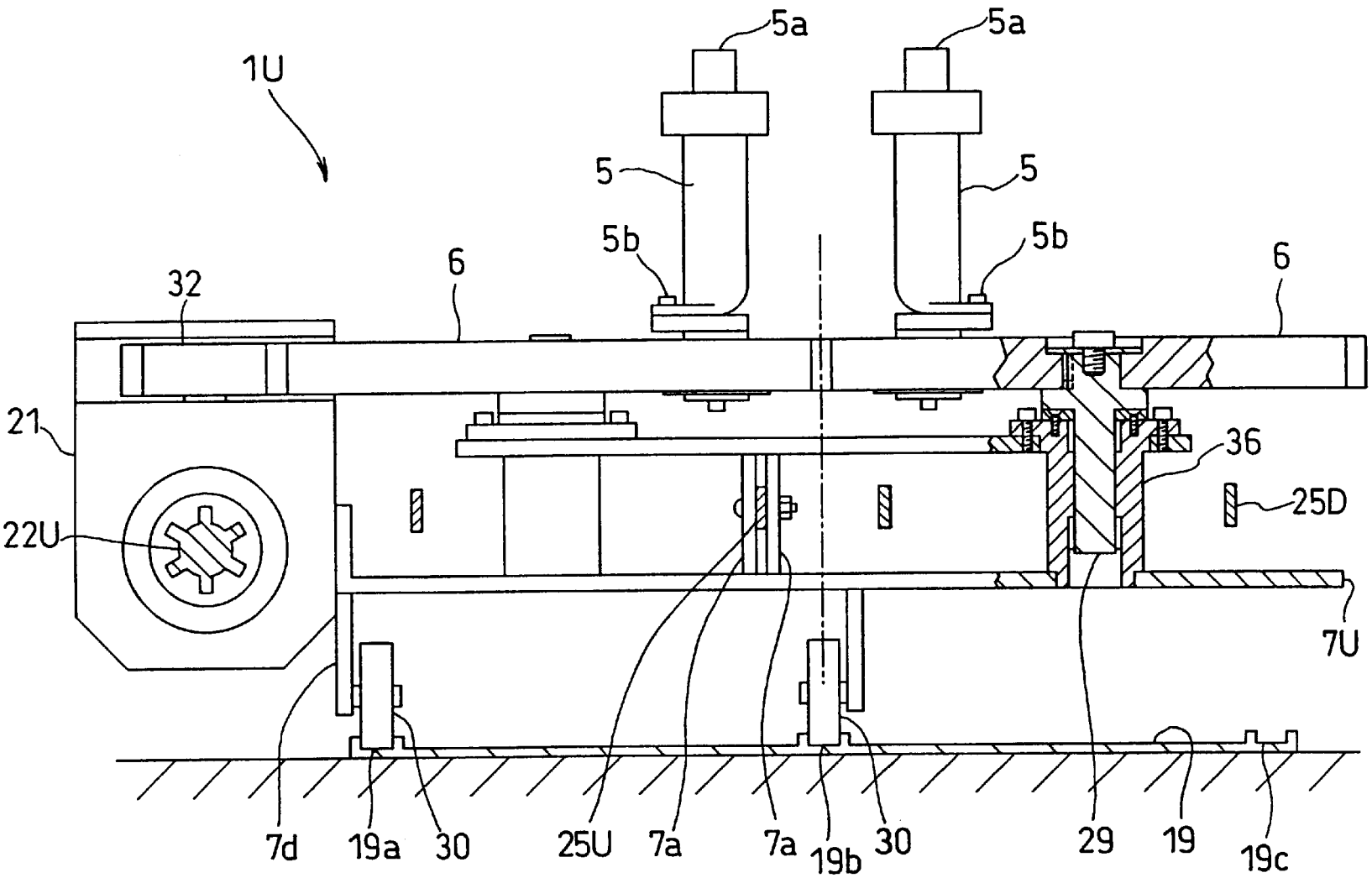
FIG. 18 is a plan view showing the jet device according to the other embodiment of the present invention.

FIGS. 16 to 18, inclusive, illustrate a jet device according to a seventh embodiment of the present invention. In this embodiment, the jet device comprises an upper-half jet device 1U for the upper half of the body of a person being massaged and a lower-half jet device 1D for the lower half of the body thereof. As shown in FIG. 17, a water container 2 is provided with drive pulleys 24U and 24D and follower pulleys 23U and 23D on the respective lengthwise ends of the bottom surface 2*b*, and a belt 25U for transferring the jet device is wound about the pulleys 23U and 24U while a belt 25D for transferring the jet device is wound about the pulleys 23D and 24D. Beneath the belts 25U and 25D for transferring the respective the jet devices is disposed a rail 19 common for the upper-half and the lower-half of the body of the person being massaged along and in parallel to the belts 25U and 25D for transferring the jet devices. A spline shaft 22U is disposed along the side of the belt 25U for transferring the jet device and a spline shaft 22D is disposed along the side of the belt 25D for transferring the jet device. In the drawings, reference symbols 9U and 9D stand for blow-off outlets, reference symbols 10U and 10D for water inlets, reference symbols 11U and 11D for circulating pumps, reference 17U and 17D for motors for transferring the nozzles, and reference symbols 19*a*, 19*b* and 19*c* each for a rail groove.

The upper-half jet device 1U has a construction substantially the same as the construction of the jet device according to the first embodiment above, as shown in FIG. 18. In the upper-half jet device 1U, a carrier 7U is connected to and associated with the jet device-transferring belt 25U. On the other hand, the lower-half jet device 1D has the construction symmetrical sideways to the construction of the upper-half jet device 1U, in which a carrier 7D is connected to and associated with the belt 25D for transferring the jet device.

In this embodiment, the jet device-transferring belts 25U and 25D are rotated by driving the motors 16U and 16D for driving the belts, respectively, to reciprocally transfer the jet devices 1U and 1D connected to the belts 25U and 25D, respectively, in an independent manner in the lengthwise direction within the water container 2 along the rail 19, that is, reciprocally in the heightwise direction of the person P being massaged while lying on the flexible sheet 3.

Figure 28:
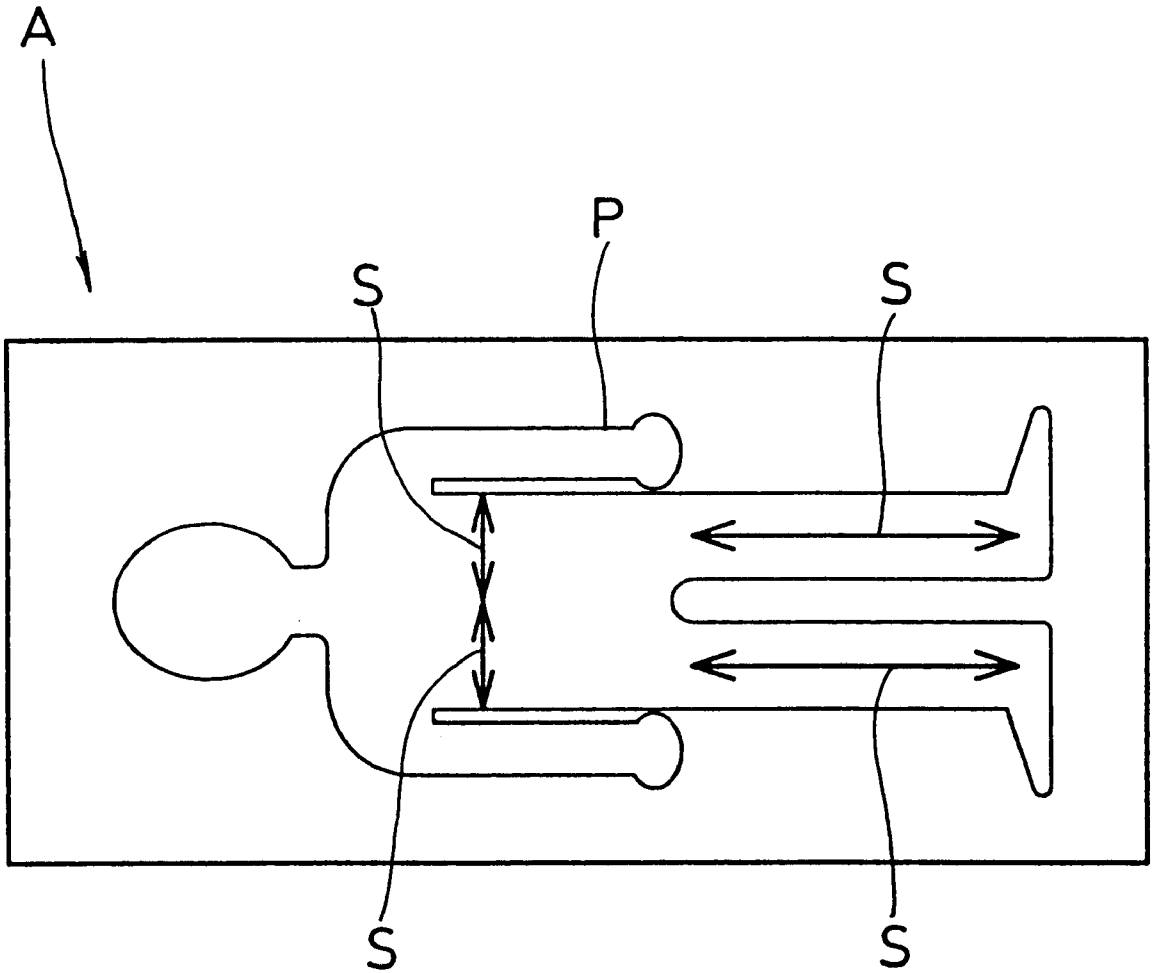
FIG. 28 is a view for describing loci of massaging locations when nozzles are transferred reciprocally in the breadthwise direction of the shoulders of the person being massaged for the upper half of the body thereof and when the nozzles are transferred reciprocally in the heightwise direction for the lower half of the body of the person being massaged.
Figure 29:
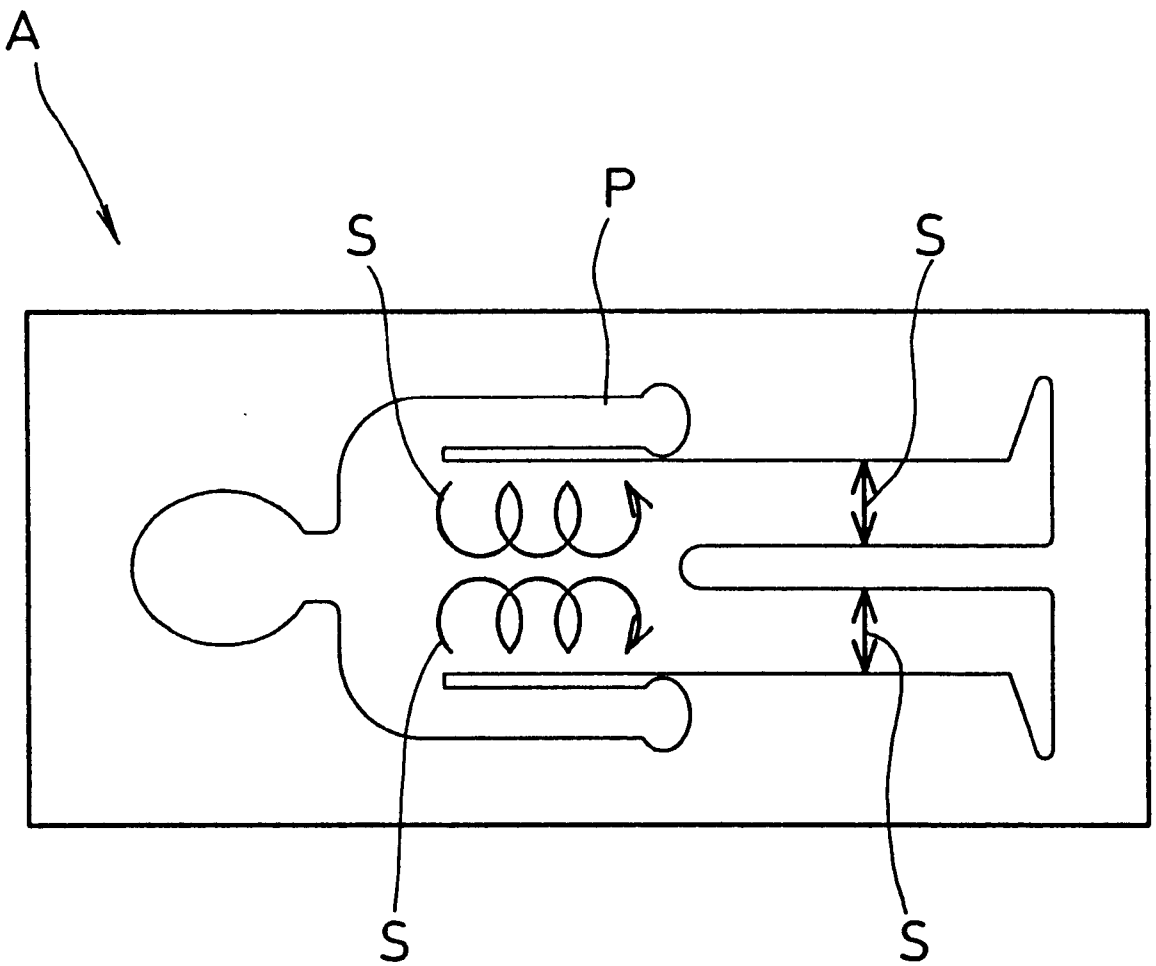
FIG. 29 is a view for describing loci of massaging locations when nozzles are transferred in the heightwise direction of the person being massaged while rotating the nozzles for the upper half of the body of the person being massaged and when the nozzles are transferred reciprocally in the breadthwise direction of the shoulders of the person being massaged for the lower half of the body of the person being massaged.

Therefore, the water bed type massaging machine A can carry out various modes of massaging each of the upper half and the lower half of the body of the person P being massaged in an appropriate manner (referring to FIGS. 28 and 29).

FIG. 28 shows loci S of massaging locations when the nozzles 5 and 5 are transferred reciprocally in the breadthwise direction of the shoulders of the person P being massaged for the upper half of the body thereof and when they are transferred reciprocally in the heightwise direction of the person for the lower half of the body thereof said jet FIG. 29 indicates loci S of massaging locations when the nozzles 5 and 5 are transferred in the heightwise direction of the person being massaged while rotating them for the upper half of the body of the person being massaged and when the nozzles 5 and 5 are transferred reciprocally in the breadthwise direction of the shoulders of the person being massaged for the lower half of the body thereof.

An appropriate combination of various modes of massaging as shown in FIGS. 21 to 27 above can carry out various modes of massaging simultaneously in accordance with the locations of the person P being massaged.

Figure 19:
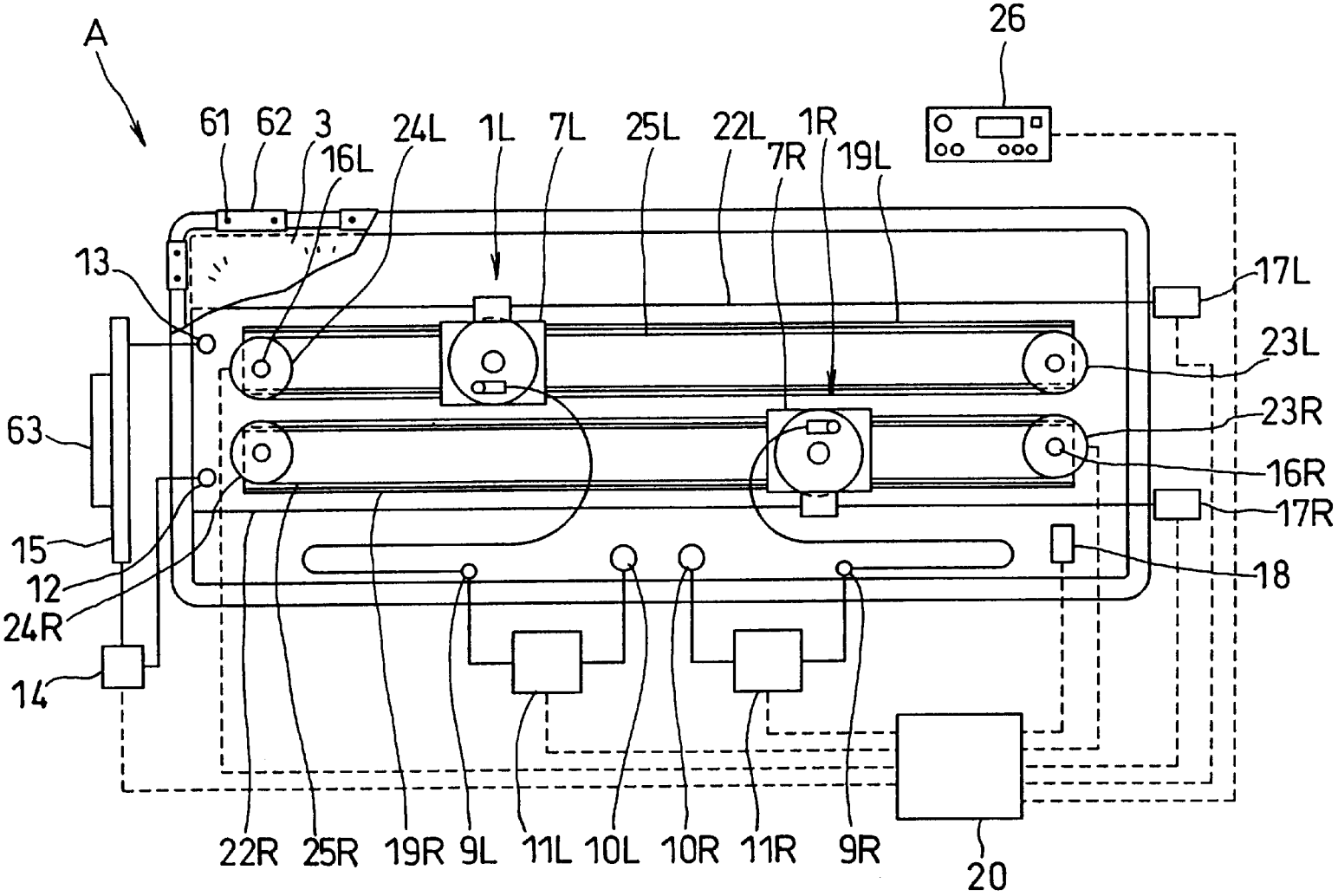
FIG. 19 is a side view for describing a water bed type massaging machine according to an other embodiment of the present invention.
Figure 20:
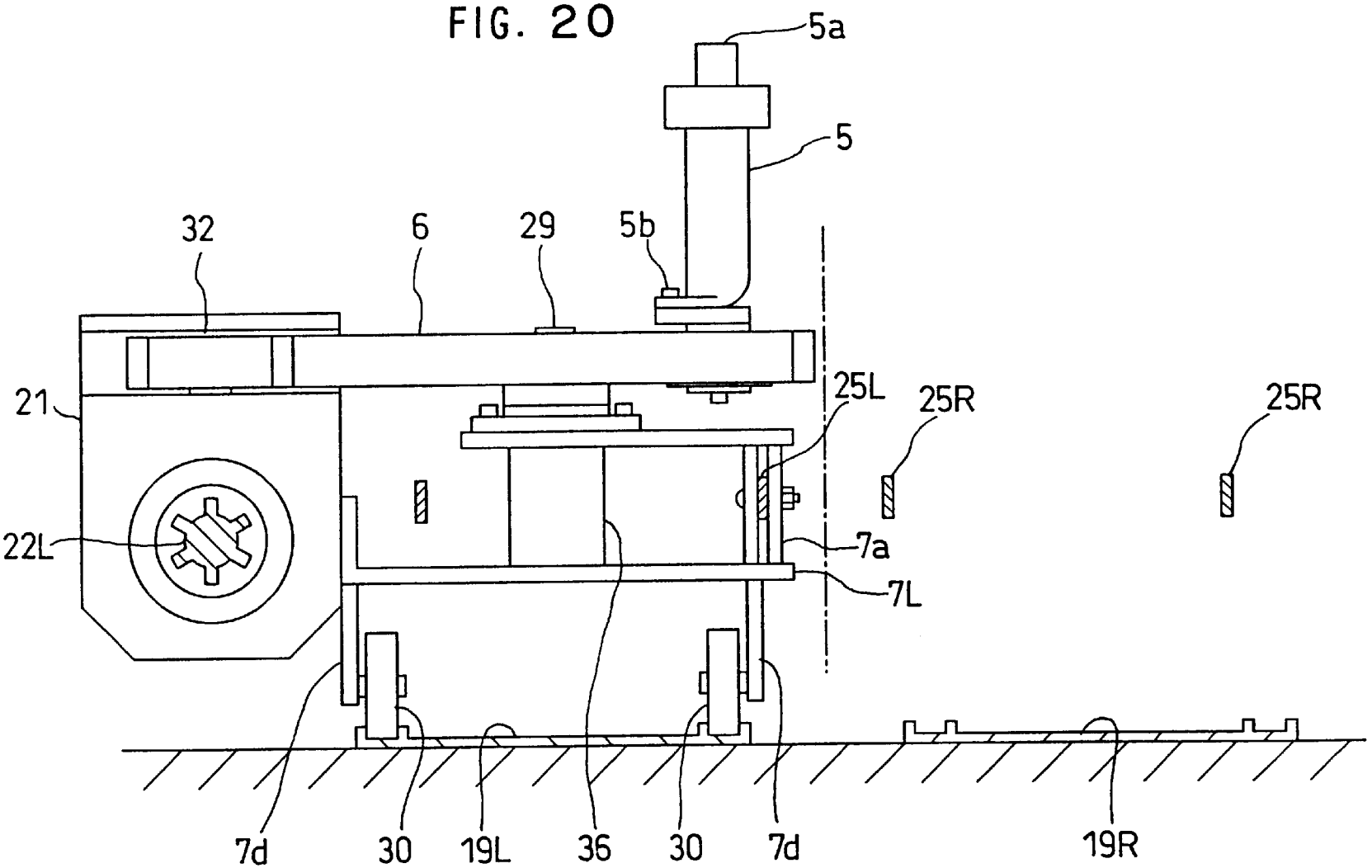
FIG. 20 is a plan view showing the jet device according to the other embodiment of the present invention.

FIGS. 19 and 20 illustrate a jet device according to an eighth embodiment of the present invention. In this embodiment, the jet device comprises a left-side jet device 1L for the left-hand side of a person being massaged and a right-side jet device 1R for the right-hand side thereof said jet As shown in FIG. 19, a water container 2 is provided with drive pulleys 24L and 24R and follower pulleys 23L and 23R on the lengthwise ends of the bottom surface 2*b*, and a belt 25L for transferring the jet device is wound about the pulleys 23L and 24L while a belt 25R for transferring the jet device is wound about the pulleys 23R and 24R. Beneath the belts 25L and 25R for transferring the respective the jet devices are disposed rails 19L and 19R along and in parallel to the belts 25L and 25R for transferring the jet devices, respectively. A spline shaft 22L is disposed along the side of the belt 25L for transferring the jet device and a spline shaft 22R is disposed along the side of the belt 25R for transferring the jet device. In the drawings, reference symbols 9L and 9R stand for blow-off outlets, reference symbols 10L and 10R for water inlets, reference symbols 11L and 11R for circulating pumps, and reference 17L and 17R for motors for transferring the nozzles.

As shown in FIG. 20, the left-side jet device 1L supports axially the nozzle-transferring gear 5 on the upper portion of a carrier 7L and the nozzle 5 is mounted on the upper surface of the nozzle-transferring gear 6 so as to be rotatable about the rotary shaft 5*b*. In the left-side jet device 1L, the carrier 7L is connected to and associated with the jet device-transferring belt 25L. On the other hand, the right-side jet device 1R has the construction symmetrical sideways to the construction of the left-side jet device 1L, in which a carrier 7R is connected to and associated with the belt 25R for transferring the jet device.

In this embodiment, the jet device-transferring belts 25L and 25R are rotated by driving the motors 16L and 16R for driving the belts, respectively, to reciprocally transfer the jet devices 1L and 1R connected to the belts 25L and 25R, respectively, in an independent manner in the lengthwise direction of the water container 2 along the rails 19L and 19R, that is, reciprocally in the heightwise direction of the person P being massaged while lying on the flexible sheet 3 independently for the left-half and right-half sides of the person's body being massaged.

Figure 30:
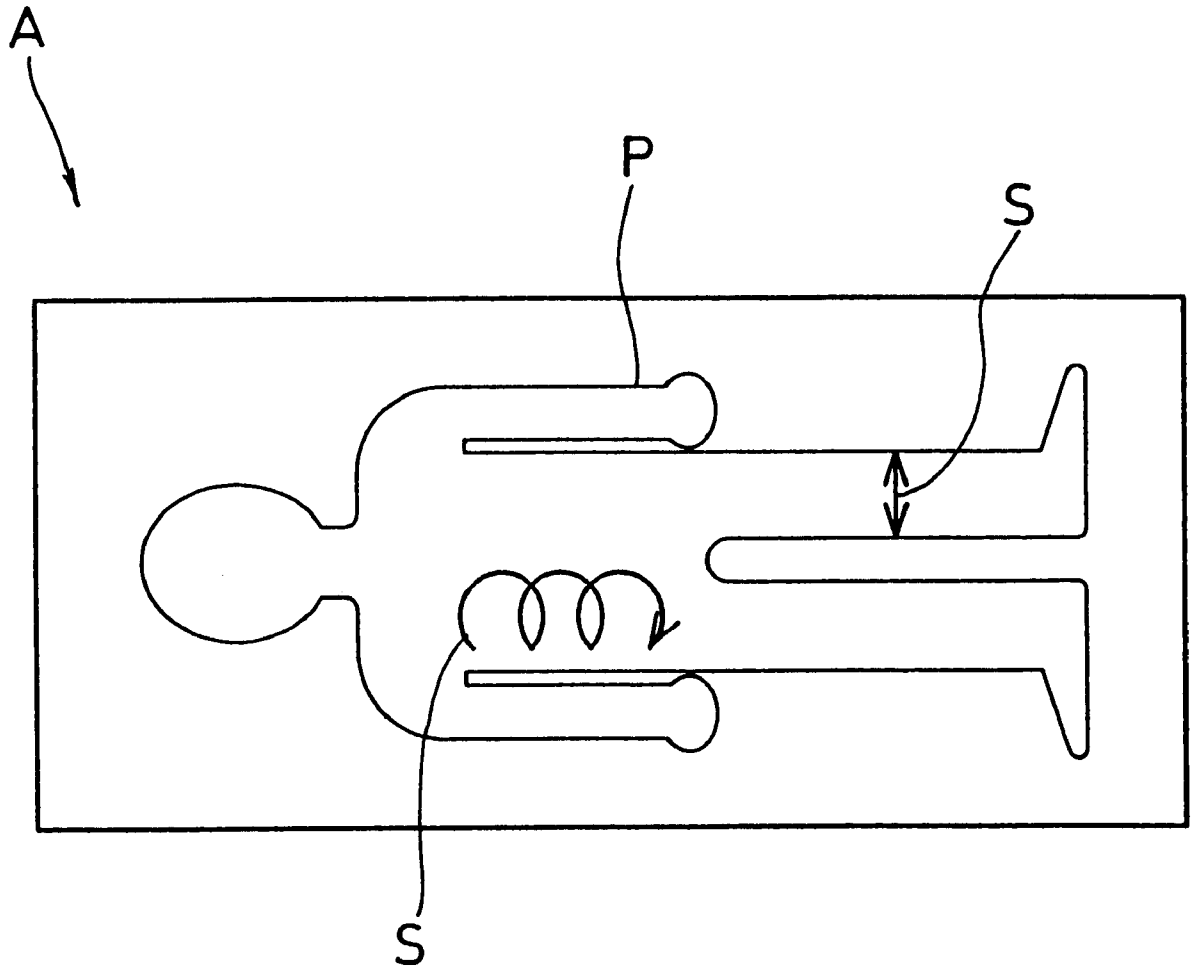
FIG. 30 is a view for describing loci of massaging locations when nozzles are transferred in the heightwise direction of the person being massaged while rotating the nozzles for the right side of the body of the person being massaged and when the nozzles are transferred reciprocally in the breadthwise direction of the shoulders of the person being massaged for the left side of the body of the person being massaged.

Therefore, the water bed type massaging machine A can carry out various modes of massaging each of the upper half and the lower half of the body of the person P being massaged in an appropriate manner (referring to FIG. 30).

FIG. 30 shows loci S of massaging locations when the nozzles 5 and 5 are transferred in the heightwise direction of the person P being massaged while rotating them for the left-half side of the person's body being massaged and when the nozzles 5 and 5 are transferred reciprocally in the breadthwise direction of the shoulders of the person P being massaged for the right-half side of the person's body being massaged.

The water bed type massaging machine according to the present invention can implement various modes of massaging simultaneously in accordance with the locations of the person P being massaged by combining various modes of massaging as shown in FIGS. 21 to 27, inclusive, in an appropriate manner.

INDUSTRIAL UTILIZABILITY

The present invention can be practiced in the manner as described hereinabove and demonstrate the effects as will be described hereinafter.

More specifically, the water bed is constructed with a box-shaped water container with an opening portion disposed on top thereof, in which water or warm water is filled, and with a flexible sheet disposed covering the opening portion in a water-tight manner, so as to allow a person being massaged to lie on the upper surface of the flexible sheet. Also, the interior of the water container is provided with light-hand and right-hand nozzles capable of blowing water or warm water against the back surface of the flexible sheet and the light-hand and right-hand nozzles are disposed so as to be transferred each in the heightwise direction and in the breadthwise direction of the shoulders of the person being massaged, including being transferred in a rotatable way. Therefore, the person being massaged can be massaged over the entire body thereof by providing stimuli thereto by jet streams to the person being massaged in a state in which the person is lying on the flexible sheet, thereby assisting the person being massaged in recovering or relieving from fatigue and alleviating localized stiff muscle of the person being massaged.

Also, the water bed is constructed with a box-shaped water container with an opening portion disposed on top thereof, in which water or warm water is filled, and with a flexible sheet disposed covering the opening portion in a water-tight manner, so as to allow a person being massaged to lie on the upper surface of the flexible sheet, wherein the water container is provided within the interior thereof with a pair of light-hand and right-hand nozzles so as to blow water or warm water toward the back surface of the flexible sheet and the pair of the light-hand and right-hand nozzles are further disposed so as to move in the heightwise direction of the person being massaged as well as to move in the breadthwise direction of the shoulders of the person symmetrically in the left- and right-hand directions. Therefore, the water bed is arranged to transfer the pair of the nozzles in the heightwise direction and in the breadthwise direction of the shoulders of the person being massaged, including rotating the nozzles, thereby providing comfortable and pleasant stimuli onto various locations symmetrically sideways in the breadthwise direction of the shoulders with respect to the backbone of the person being massaged centered therebetween and consequently achieving higher massaging effects.

Further, the water container is disposed in the interior thereof with the carrier so as to be movable in the heightwise direction of the person being massaged and a pair of the gears for transferring the nozzles are rotatably disposed on top of the carrier in a state in which they are engaged while the nozzles are provided on the pair of the gears for transferring the nozzles. Therefore, the pair of the nozzles can be transferred, including rotating, and the jet device can be formed into a simple structure, thereby providing the water bed type massaging machine which can be assembled in a ready manner and has a high degree of maintenance performance.

Furthermore, as the water bed type massaging machine is provided with the temperature adjustment means for adjusting the temperature of water or warm water filled in the interior of the water container, the water or the like in the water container can be heated or cooled to maintain the temperature of the water or the like in the water container always at an optimal level. In addition, the water bed type massaging machine according to the present invention can sustain the flexible sheet at an optimal temperature so that massaging effects can be enhanced and the person being massaged while lying on the flexible sheet can enjoy the massaging without undergoing an unpleasant feeling because the flexible sheet does not become too hot or too cold.

Moreover, the water bed type massaging machine can be operated continuously for a long period of time because the hot water or the like in the water container can be cooled down even if the temperature of the water or the like in the water container would become higher due to friction of the water or the like.

What is claimed is:

1. A massaging water bed, comprising:

a box-shaped water container including an opening portion on a top thereof;

a flexible sheet being disposed over the opening portion of the water container in a watertight manner, on which a person being massaged lies;

a jet device for jetting water being disposed to move within said water container in lengthwise and widthwise directions of said water container, said jet device including a nozzle, a pair of nozzle-transferring gears for transferring said nozzle and a carrier;

a circulating pump;

a drive pulley and a follower pulley each being disposed in said water container;

a jet device-transferring belt wound about said drive pulley and said follower pulley, said carrier being connected at a central widthwise location thereof to said jet device-transferring belt;

a nozzle-transferring motor which is coupled with said jet device-transferring belt;

a spline shaft disposed within said water container and arranged along said jet device-transferring belt, coupled with said nozzle-transferring motor;

said pair of nozzle-transferring gears being rotatably held in an engaged state on top of said carrier, said nozzle being disposed on top of each of said pair of nozzle-transferring gears;

said jet device being moved within said container in a lengthwise direction of said water container by driving said nozzle-transferring motor coupled with the drive pulley to move said carrier within said container in a lengthwise direction thereof; and said nozzle being moved within said water container in a widthwise direction of said water container by driving said nozzle-transferring motor, said nozzle being coupled with a water jetting opening formed within said water container through a flexible hose for jetting water, said water jetting opening being coupled with said circulating pump, said nozzle jetting water against a back surface of said flexible sheet by driving the circulating pump.

2. A massaging water bed, comprising:

a box-shaped water container having an opening portion on top thereof, the opening portion being covered a watertight manner with a flexible sheet on which a person being massaged lies; and at least two jet devices for jetting water against a back surface of the flexible sheet being disposed to move in a separate and discrete manner within said water container in lengthwise and widthwise directions of said water container, one of said at least two jet devices moving unmeshingly with respect to another of said at least two jet devices.

3. The massaging water bed as claimed in claim 2, wherein:

each of said jet devices comprises a nozzle, a gear for transferring said nozzle and a carrier, and is disposed to move within said water container in lengthwise and widthwise directions of said water container;

said nozzle is disposed on top of each of said nozzle-transferring gears for transferring the nozzle;

said nozzle-transferring gears are rotatably held in an engaged state on top of said carrier;

said carrier is mounted on a jet device-transferring belt wound about a drive pulley and a follower pulley each disposed in said water container;

said water container is provided therein with a spline shaft along said jet device-transferring belt, and is coupled with a nozzle-transferring motor which in turn is coupled with said jet device-transferring belt;

said jet device is moved within said container in a lengthwise direction of said water container by driving a nozzle-transferring motor coupled with the drive pulley to move said carrier within said container in a lengthwise direction thereof.

said nozzle is moved within said water container in a widthwise direction of said water container by driving said nozzle-transferring motor; and said nozzle is coupled with a water jetting opening formed within said water container through a flexible hose for jetting water, and said nozzle jetting water against a back surface of said flexible sheet by driving a circulating pump coupled with the water jetting opening.

4. The massaging water bed as claimed in claim 1 or 3, wherein:

said nozzle is moved within said water container in a widthwise direction of said water container by driving the nozzle-transferring motor coupled with the spline shaft that in turn is spline-engaged with a driving bevel gear engaged with a follower bevel gear coupled with the nozzle-transferring gear.

* * * * *